US012721418B2

(12) United States Patent
Kintaka

(10) Patent No.: US 12,721,418 B2
(45) Date of Patent: Sep. 1, 2026

(54) APPLICATION CONTAINER WITH HOLDING PORTION FOR APPLICATION MATERIAL

(71) Applicant: TOKIWA CORPORATION, Nakatsugawa (JP)

(72) Inventor: Kengo Kintaka, Kawaguchi (JP)

( * ) Notice: Subject to any disclaimer, the term of this patent is extended or adjusted under 35 U.S.C. 154(b) by 163 days.

(21) Appl. No.: 18/765,335

(22) Filed: Jul. 8, 2024

(65) Prior Publication Data

US 2025/0017354 A1 Jan. 16, 2025

(30) Foreign Application Priority Data

Jul. 10, 2023 (JP) ..... 2023-112920

(51) Int. Cl.
*A45D 40/20* (2006.01)
*A45D 40/04* (2006.01)

(52) U.S. Cl.
CPC ..... *A45D 40/205* (2013.01); *A45D 40/04* (2013.01); *A45D 40/20* (2013.01); *A45D 2040/208* (2013.01); *A45D 2200/1072* (2013.01)

(58) Field of Classification Search
CPC ..... A45D 40/04; A45D 40/205; A45D 40/20; A45D 2040/208; A45D 2200/1072; A45D 40/02; A45D 2200/05
USPC ..... 401/55, 68, 88
See application file for complete search history.

(56) References Cited

U.S. PATENT DOCUMENTS 2,338,068 A * 12/1943 Harris ..... B43K 21/08 24/11 C
5,598,604 A * 2/1997 Ho ..... B43L 19/0081 15/433
6,793,429 B2 * 9/2004 Arrison ..... B43K 23/016 401/117
7,645,083 B2 * 1/2010 Burry ..... B43K 23/008 401/55
2021/0298455 A1 9/2021 Tani

FOREIGN PATENT DOCUMENTS

JP 2021-151379 9/2021

* cited by examiner

*Primary Examiner* — David J Walczak
(74) *Attorney, Agent, or Firm* — SHIPWAY IP

(57) ABSTRACT

An application container for an application material includes a tubular member having a tube hole to moveably accommodate the application material in an axial direction of the tubular member, and an opening to expose the application material. A shape of the tube hole when viewed along the axial direction has a flattened shape having a major axis and a minor axis, the flattened shape extending substantially along the major axis. The tubular member includes a holding portion configured to contact the application material.

16 Claims, 23 Drawing Sheets

APPLICATION CONTAINER WITH HOLDING PORTION FOR APPLICATION MATERIAL

CROSS-REFERENCE TO RELATED APPLICATIONS

This application claims the benefit of priority from Japanese Patent Application No. P2023-112920, filed Jul. 10, 2023, the entire contents of which are incorporated herein by reference.

BACKGROUND

Japanese Unexamined Patent Publication No. 2021-151379 describes an application container including a front tube that accommodates an application material thereinside, and that includes an opening through which the application material is exposed. The opening extends in a major axis direction intersecting an axial direction. The front tube includes a front edge that is curved to bulge toward the outside of the front tube as the front edge extends from a tip located on one side in the major axis direction toward the other side in the major axis direction and the rear.

When viewed from the other side in the major axis direction, the opening extends in a slit shape rearward from the tip. First application material holding portions located on both sides of the opening in a minor axis direction are formed at a tip portion of the front tube having an outer surface that extends rearward while being curved to bulge from the tip to the outside of the front tube. A second application material holding portion is formed on the one side of the opening in the major axis direction, the opening extending in a slit shape.

In the application container described above, the application material is held by the first application material holding portions and the second application material holding portion provided at the tip portion of the front tube. However, there are locations other than the tip portion of the front tube, in which the application material is not held. In a case where the application material has a flattened shape, when there are many locations where the application material is not held as described above, the application material deforms or breaks, which is a concern. Particularly, there is a possibility that deformation or breakage of the application material occurs when the application material having a flattened shape is loaded into the application container, when the application material having a flattened shape is fed out, or when the application container is carried.

SUMMARY

An application container according to one example is an application container that feeds out an application material. The application container includes a tubular member including a tube hole that accommodates the application material, and an opening through which the application material is exposed; and a feed-out mechanism that advances the application material to cause the application material to protrude from the opening, the application material being accommodated in the tube hole. A shape of the tube hole of the tubular member when viewed along an axial direction that is a direction in which an axis of the tubular member extends and a shape of the application material when viewed along the axial direction are a flattened shape having a major axis and a minor axis. The application material has a thickness in a minor axis direction that is a direction in which the minor axis extends. The application material includes a flattened surface extending in a major axis direction that is a direction in which the major axis extends, and the axial direction. The tubular member includes a holding portion that holds the application material by coming into contact with the flattened surface. The holding portion extends from one end side toward the other end side of the flattened surface in the axial direction in a state where the holding portion is in contact with the flattened surface.

The application container includes the tubular member that accommodates the application material, and the feed-out mechanism that feeds out the application material accommodated in the tubular member, and the feed-out mechanism causes the application material to protrude from the tubular member by feeding out the application material. The shape of the tube hole of the tubular member when viewed along the axial direction and the shape of the application material when viewed along the axial direction are a flattened shape having a major axis and a minor axis.

The application material includes the flattened surface extending in the axial direction and the major axis direction, and the tubular member includes the holding portion that holds the application material by coming into contact with the flattened surface. The holding portion that comes into contact with the flattened surface of the application material extends from the one end side toward the other end side of the flattened surface in the axial direction. Therefore, by setting the holding portion to extend from one side toward the other side of the flattened surface in the axial direction in a state where the holding portion is in contact with the flattened surface, the holding portion may hold the application material in a wide range from the one side toward the other side in the axial direction. Therefore, even when the holding portion holds the application material including a flattened shape, since the holding portion holds the application material in a range from the one side toward the other side of the flattened surface in the axial direction, deformation and breakage of the application material can be suppressed.

An application container according to another example is an application container that feeds out an application material. The application container includes a tubular member including a tube hole that accommodates the application material, and an opening through which the application material is exposed; and a feed-out mechanism that advances the application material to cause the application material to protrude from the opening, the application material being accommodated in the tube hole. A shape of the tube hole when viewed along an axial direction that is a direction in which an axis of the tubular member extends and a shape of the application material when viewed along the axial direction are a flattened shape having a major axis and a minor axis. The application material has a thickness in a minor axis direction that is a direction in which the minor axis extends. The application material includes a flattened surface extending in a major axis direction that is a direction in which the major axis extends, and the axial direction. The tubular member includes a holding portion that holds the application material by coming into contact with the flattened surface. The holding portion is a leaf spring portion defined by a slit formed in the tubular member. The leaf spring portion comes into contact with the application material, and elastically deforms along a thickness direction of the tubular member.

In the application container, the shape of the tube hole of the tubular member when viewed along the axial direction and the shape of the application material when viewed along the axial direction are a flattened shape having a major axis and a minor axis, and the application material includes the flattened surface extending in the axial direction and the major axis direction. The tubular member includes the holding portion that holds the application material by coming into contact with the flattened surface, and the holding portion is the leaf spring portion defined by the slit formed in the tubular member. The leaf spring portion comes into contact with the application material, and elastically deforms along the thickness direction of the tubular member. Therefore, the leaf spring portion that elastically deforms can hold the application material in a wide range by coming into contact with the flattened surface. Therefore, even when the leaf spring portion holds the application material having a flattened shape, since the leaf spring portion comes into contact with the flattened surface to hold the application material, the application material can be held with an appropriate holding force, and deformation and breakage of the application material can be suppressed.

In some of the above-described examples, the holding portion may have a protruding shape protruding toward the flattened surface. The tubular member may include a plurality of the holding portions arranged along the major axis direction and arranged along the minor axis direction. The application material may be sandwiched between the plurality of holding portions arranged along the minor axis direction. In this case, since the application material is held in a state where the application material is sandwiched between a pair of the holding portions arranged along the minor axis direction, the application material can be more firmly held by the plurality of holding portions. As a result, deformation and breakage of the application material can be more reliably suppressed.

In some of the above-described examples, the tubular member may include a first constituent member and a second constituent member joined to the first constituent member. In this case, the application material can be held between the first constituent member and the second constituent member. Therefore, by joining the second constituent member to the first constituent member in a state where the application material is interposed between the first constituent member and the second constituent member, the loading of the application material into the tubular member can be easily performed.

In some of the above-described examples, the first constituent member and the second constituent member may be joined to each other along a direction orthogonal to the axial direction. In this case, since the application material can be held between the first constituent member and the second constituent member facing each other along the direction orthogonal to the axial direction, the loading and holding of the application material can be easily performed.

In some of the above-described examples, the first constituent member and the second constituent member may be joined to each other along the axial direction. In this case, since the first constituent member is joined to the second constituent member along the axial direction, the joining of the first constituent member to the second constituent member can be easily performed.

In some of the above-described examples, the application container may further include a front tube that accommodates the tubular member, and that includes a first female screw inside the front tube; a rear tube coupled to the front tube to be rotatable relative to the front tube; a screw tube provided inside the rear tube, and including a first male screw that screws into the first female screw and a second female screw formed on an inner surface of the screw tube; and a movable body that advances inside the screw tube, and that includes a second male screw that screws into the second female screw. The feed-out mechanism may include a first screwing portion that advances the screw tube with respect to the front tube through a screwing action between the first female screw and the first male screw when the screw tube rotates relative to the front tube, and a second screwing portion that advances the movable body with respect to the screw tube through a screwing action between the second female screw and the second male screw when the rear tube rotates relative to the screw tube. When the rear tube rotates relative to the front tube in one direction, the screw tube may rotate synchronously with the rear tube, and the screw tube may advance to an advance limit with respect to the rear tube, so that the tubular member and the application material protrude forward from the front tube. When the rear tube rotates relative to the front tube in the one direction in a state where the screw tube reaches the advance limit, the rear tube may rotate relative to the screw tube, and the movable body may advance with respect to the screw tube, so that the application material may be fed out with respect to the tubular member. In this case, since the application material can be advanced together with the tubular member by rotating the rear tube relative to the front tube in the one direction, deformation and breakage of the application material when the application material is fed out can be suppressed. In addition, in a state where the screw tube reaches the advance limit and the tubular member and the application material protrude forward from the front tube, the application material is fed out with respect to the tubular member for the first time. Therefore, since the feed-out amount of the application material with respect to the tubular member can be reduced, breakage of the application material when application is performed can be more reliably suppressed.

According to the present disclosure, it is possible to suppress deformation and breakage of the application material having a flattened shape.

DETAILED DESCRIPTION

In the following description, with reference to the drawings, the same reference numbers are assigned to the same components or to similar components having the same function, and overlapping description is omitted.

In the present disclosure, the term "application material" refers to a material that is applied to a portion to be applied which is an application target. The "application material" is, for example, a cosmetic or a drawing material. In the present disclosure, examples in which the application material is a cosmetic will be described. The "cosmetic" is, for example, an eyebrow product, an eyeliner, a lipstick, a lip liner, a lip gloss, a beauty stick, or a concealer.

Figure 1A:
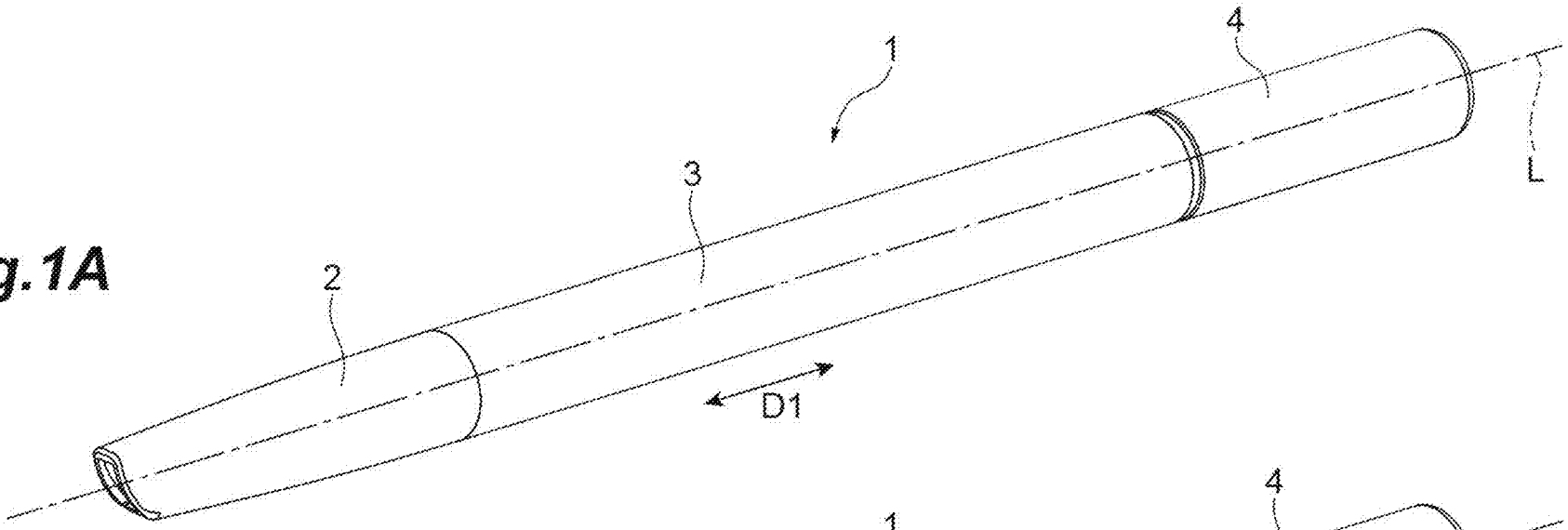
FIG. 1A is a perspective view showing an application container according to an example.
Figure 1B:
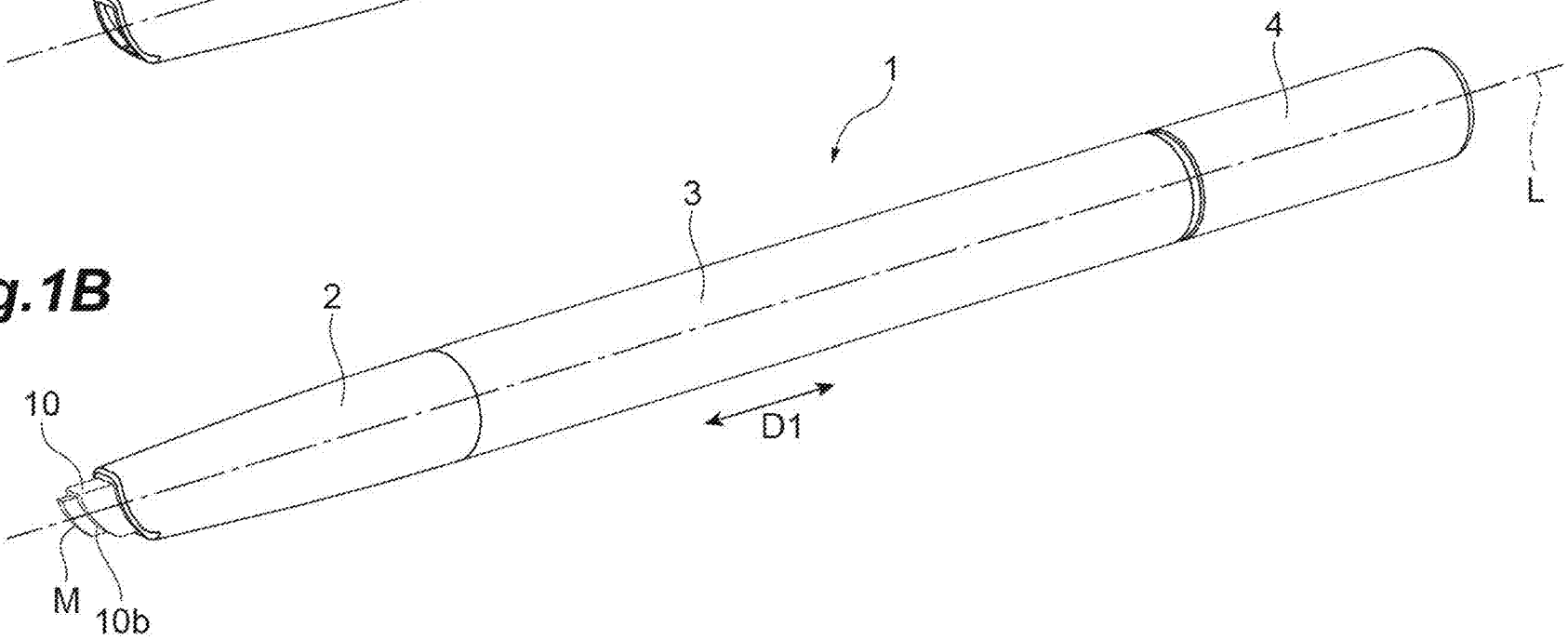
FIG. 1B is a perspective view showing a state where a tubular member and an application material are fed out from the application container of FIG. 1A.

FIG. 1A is a perspective view showing an application container 1 according to an example. FIG. 1B is a perspective view showing a state where an application material M is fed out from the application container 1. As shown in FIG. 1A and FIG. 1B, the application container 1 includes a front tube 2; a rear tube 3 coupled to the front tube 2; and a cap 4 coupled to the rear tube 3.

In the application container 1, some components including the front tube 2, the rear tube 3, and the cap 4 have a tubular shape. In the application container 1, in a state where the components are assembled, directions in which axes L of a plurality of the components having a tubular shape extend coincide with each other. Hereinafter, the direction in which the axis L extends is referred to as an axial direction D1. For example, the axial direction D1 coincides with a longitudinal direction of the application container 1.

The terms "front", "front side", and "forward" refer to a direction from the rear tube 3 toward the front tube 2 in the axial direction D1, and the terms "rear", "rear side", and "rearward" refer to a direction from the front tube 2 toward the rear tube 3 in the axial direction D1. The term "radial direction" refers to a direction orthogonal to the axis L. The term "radially outward" or "radial outside" refers to a direction away from the axis in the radial direction, and the term "radially inward" or "radial inside" refers to a direction toward the axis in the radial direction. The term "rotation direction" refers to a direction along an annulus centered on the axis L (circumferential direction). In the present disclosure, a feed-out direction that is a direction in which the application material M is fed out is forward (advancing direction), and the opposite direction is rearward.

The application container 1 has a rod shape extending along the axial direction D1. The application container 1 feeds out the application material M. For example, the application container 1 is a pen type container that feeds out (pushes out) the application material M accommodated inside the application container 1. The application material M has a flattened shape and is in a solid state. The application material M is, for example, a plate-shaped cosmetic. However, the application material M may be a plate-shaped drawing material. As one example, the application material M may be an eyebrow product, and in this case, the application container 1 is an eyebrow application container.

Figure 2A:
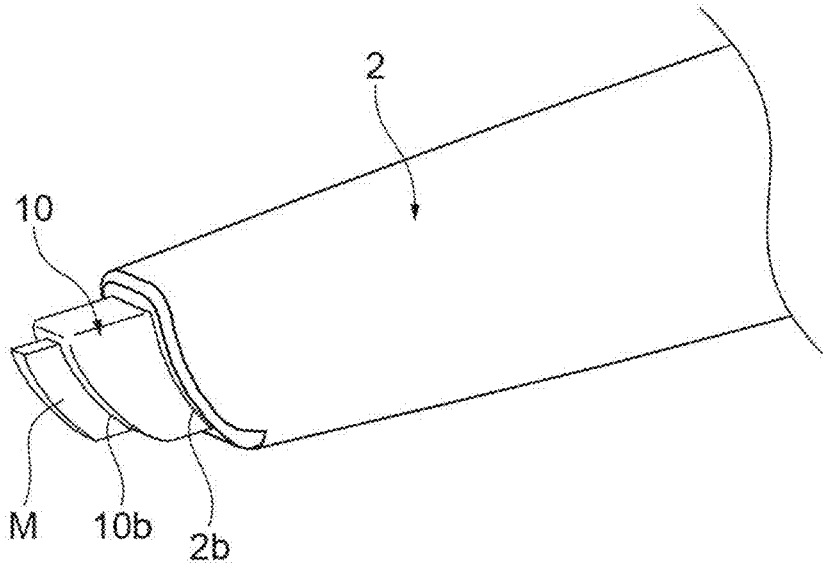
FIG. 2A is an enlarged view of the tubular member and the application material of FIG. 1B.
Figure 2B:
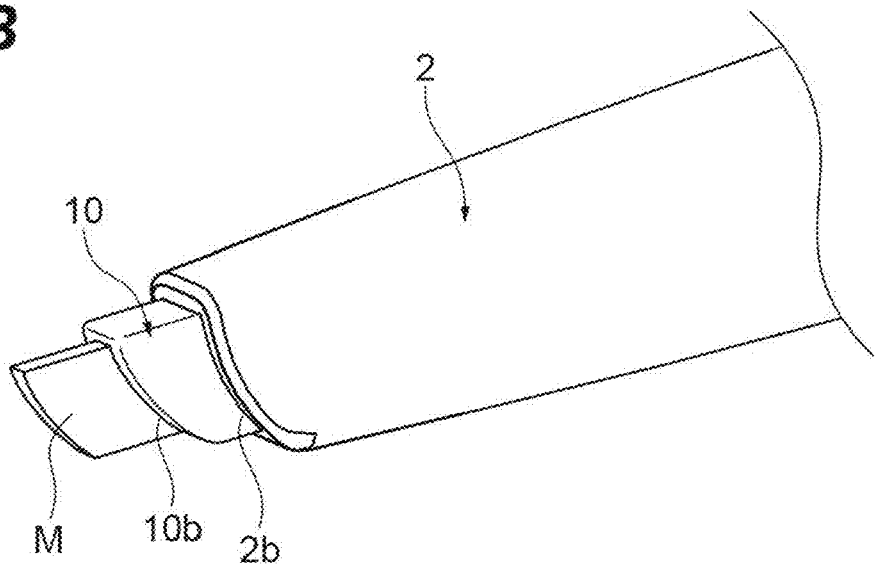
FIG. 2B is a view showing a state where the application material is further fed out from the state of FIG. 2A.
Figure 2C:
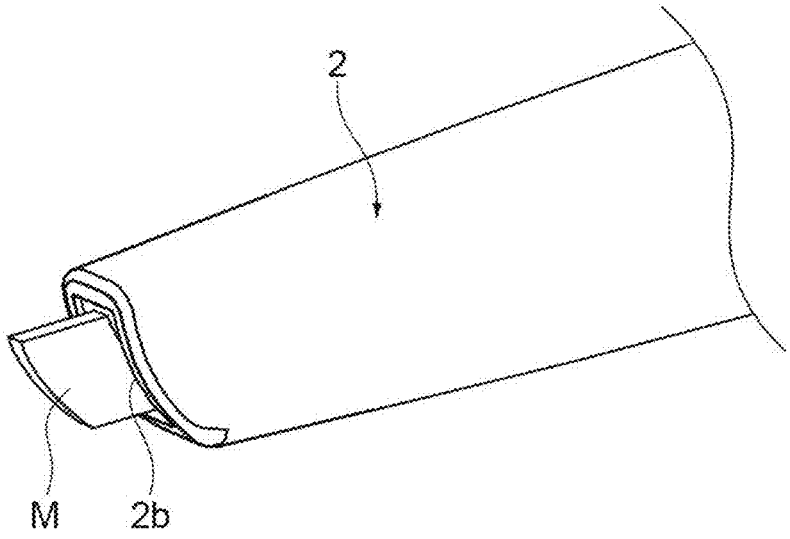
FIG. 2C is a view showing a state where the tubular member and the application material are retracted relative to the state of FIG. 2B.
Figure 3:
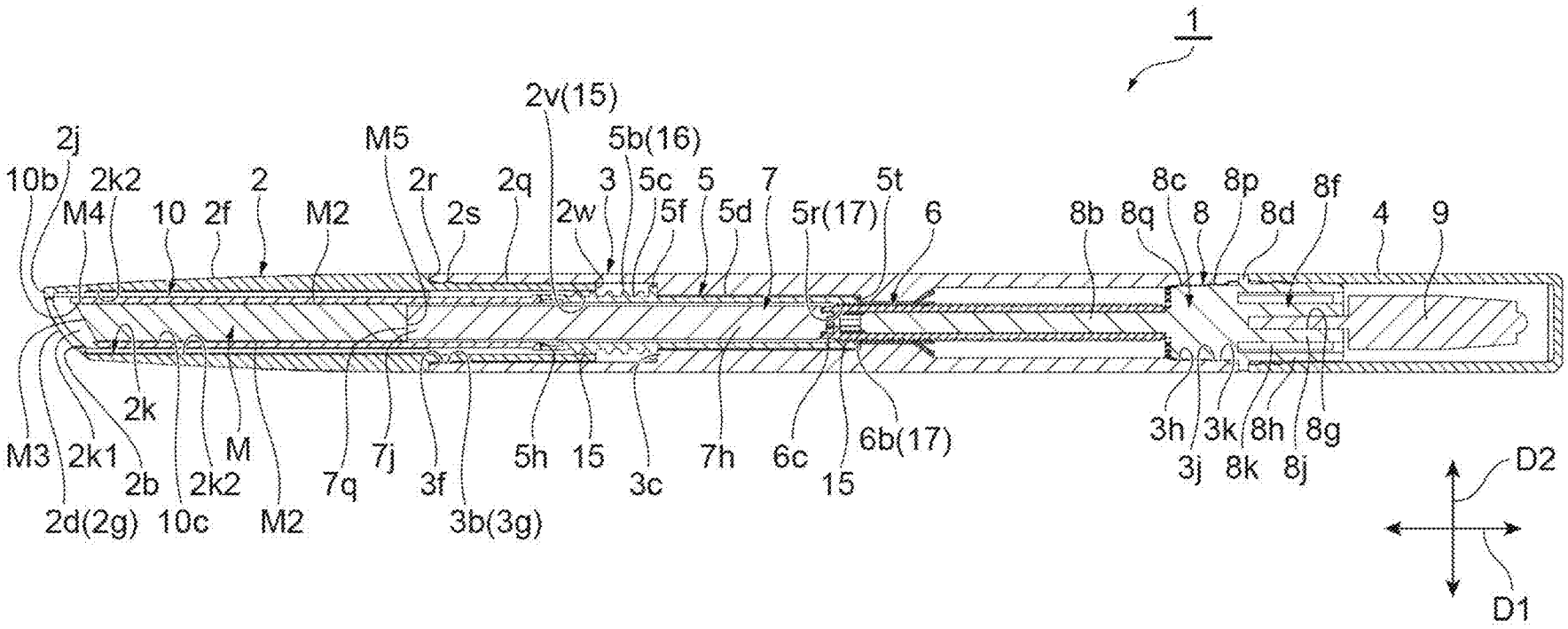
FIG. 3 is a cross-sectional view of the application container illustrated in FIG. 1A.

The application container 1 includes a tubular member 10 having an opening 10*b* through which the application material M is exposed. The rear tube 3 is coupled to the front tube 2 to be rotatable relative thereto. FIGS. 2A, 2B, and 2C are perspective views showing the front tube 2, the tubular member 10, and the application material M. FIG. 3 is a cross-sectional view showing the application container 1.

As shown in FIGS. 1A, 1B, 2A, 2B, 2C, and 3, the front tube 2 has a tip opening 2*b* through which the tubular member 10 and the application material M protrude forward. The tubular member 10 has a tube hole 10*c* that accommodates the application material M. The tube hole 10*c* extends rearward from the opening 10*b*. The application container 1 includes a feed-out mechanism 15 that advances the application material M to cause the application material M to protrude from the opening 10*b*, the application material M being accommodated in the tube hole 10*c*.

As shown in FIGS. 1A, 1B, and 2A, when the rear tube 3 rotates relative to the front tube 2 in one direction (for example, clockwise), the feed-out mechanism 15 causes the tubular member 10 and the application material M to protrude forward from the tip opening 2*b* of the front tube 2. As shown in FIGS. 2A and 2B, when the rear tube 3 further rotates relative to the front tube 2 in the one direction in a state where the tubular member 10 and the application material M protrude from the tip opening 2*b* by a certain amount, the application material M is fed out forward with respect to the tubular member 10.

As shown in FIGS. 2B and 2C, when the rear tube 3 rotates relative to the front tube 2 in an opposite direction (for example, counterclockwise) of the one direction, the feed-out mechanism 15 causes both the tubular member 10 and the application material M to retract rearward with respect to the tip opening 2*b* of the front tube 2. The application material M is advanced with respect to the tubular member 10, and is retreated together with the tubular member 10, but is not retreated with respect to the tubular member 10 by the feed-out mechanism 15. The feed-out mechanism 15 will be described in detail later.

As shown in FIG. 3, the application container 1 includes a screw tube 5 provided inside the rear tube 3; a movable body 6 that moves inside the screw tube 5; a pressing member 7 located between the movable body 6 and the application material M; a tail plug 8 that seals an end portion on the rear side of the rear tube 3; and an applicator 9 fixed to the tail plug 8. For example, the applicator 9 is inserted into the tail plug 8, and the tail plug 8 holds the inserted applicator 9. As one example, the applicator 9 is a screw brush, and the tail plug 8 functions as a brush holder.

The cap 4 is attached to the tail plug 8 to cover the applicator 9, and is attachable to and detachable from the tail plug 8. The configurations of the cap 4, the tail plug 8, and the applicator 9 are not limited to the above examples, and can be changed as appropriate. In addition, the application container 1 may be a container that does not include the applicator 9 and the cap 4. The screw tube 5, the movable body 6, and the pressing member 7 will be described in detail later.

Figure 4:
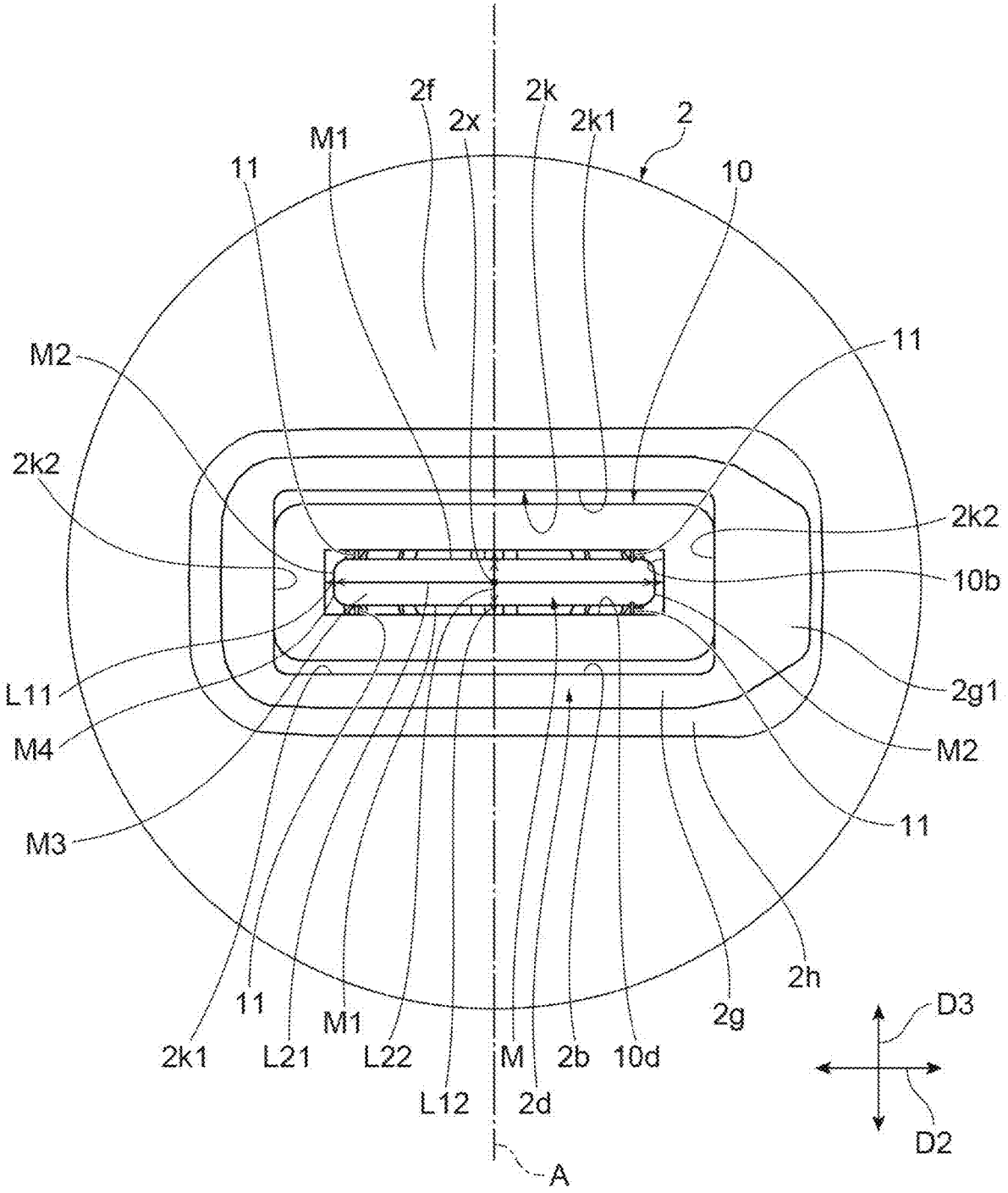
FIG. 4 is a front view showing the application container of FIG. 1A.

FIG. 4 is a view of the front tube 2, the tubular member 10, and the application material M when viewed from the front. As shown in FIGS. 3 and 4, the shape of the opening 10*b* when viewed along the axial direction D1 is a flattened shape having a major axis and a minor axis. The shape of the tube hole 10*c* when viewed along the axial direction D1 is a flattened shape having a major axis L11 and a minor axis L12, and the shape of the application material M when viewed along the axial direction D1 is a flattened shape having a major axis L21 and a minor axis L22.

For example, the major axis L21 and the minor axis L22 of the application material M coincide with the major axis L11 and the minor axis L12 of the tube hole 10*c*, respectively. In the present disclosure, the term "flattened shape" refers to a shape in which a length (or width) in a major axis direction D2 that is a direction in which the major axis L11 (major axis L21) extends is longer than a length (or thickness, or height) in a minor axis direction D3 that is a direction in which the minor axis L12 (minor axis L22) extends. The front tube 2 includes a tip 2*j*. The tip 2*j* is one end of the front tube 2 in the axial direction D1, and is located at one end of the front tube 2 in the major axis direction D2.

For example, when viewed from the front, the front tube 2 has a circular shape. The cross-sectional shape of the front tube 2 orthogonal to the axial direction D1 transitions from a circular shape to a flattened shape as the front tube 2 extends from the rear tube 3 toward the tip opening 2*b*. The front tube 2 includes a tip portion 2*d* at which the tip opening 2*b* is formed, and a tapered surface 2*f* extending from the tip portion 2*d* toward the rear tube 3. On the tapered surface 2*f*, the length of the front tube 2 in the major axis direction D2 and the length of the front tube 2 in the minor axis direction D3 are lengthened as the front tube 2 extends toward the rear tube 3.

When viewed along the axial direction D1, the tip opening 2*b* has a flattened shape (as one example, a rectangular shape with rounded corners). The tip portion 2*d* has a smooth surface 2*g* in which the tip opening 2*b* is formed, and a curved surface 2*h* extending from the smooth surface 2*g* to the tapered surface 2*f*. When viewed along the minor axis direction D3, the smooth surface 2*g* is curved to bulge to the outside of the front tube 2 as the smooth surface 2*g* extends away from the tip 2*j*.

The smooth surface 2*g* has a shape that is asymmetric with respect to a reference line A passing through a center 2*x* of the front tube 2 and extending along the minor axis direction D3 when viewed along the axial direction D1. More specifically, the smooth surface 2*g* has a protruding region 2*g*1 protruding to one side in the major axis direction D2. As one example, the protruding region 2*g*1 has a trapezoidal shape having an upper base extending along the minor axis direction D3. When viewed along the axial direction D1, the curved surface 2*h* has a rectangular shape with rounded corners which surrounds the smooth surface 2*g*. The curved surface 2*h* is curved to bulge to the outside of the front tube 2.

The front tube 2 has an inner surface 2*k* extending rearward from the tip opening 2*b*. The inner surface 2*k* includes a first inner surface 2*k*1 extending in the axial direction D1 and the major axis direction D2, and a second inner surface 2*k*2 extending in the axial direction D1 and the minor axis direction D3. The inner surface 2*k* includes a pair of the first inner surfaces 2*k*1 arranged along the minor axis direction D3, and a pair of the second inner surfaces 2*k*2 arranged along the major axis direction D2.

The application material M has a thickness in the minor axis direction D3. The application material M has a flattened surface M1 extending in the axial direction D1 and the major axis direction D2; a side surface M2 extending in the axial direction D1 and the minor axis direction D3; and a tip surface M3 located at an end portion on the front side of the application material M. The application material M has a pair of the flattened surfaces M1 arranged along the minor axis direction D3, and a pair of the side surfaces M2 arranged along the major axis direction D2. The flattened surfaces M1 and the side surfaces M2 have, for example, a flat shape.

For example, the tip surface M3 is inclined with respect to both the axial direction D1 and the major axis direction D2. The tip surface M3 is inclined along the tip portion 2*d* (smooth surface 2*g*) of the front tube 2. The application material M includes a tip portion M4. The tip portion M4 is one end of the application material M in the axial direction D1, and is located at one end of the application material M in the major axis direction D2. The tip surface M3 extends obliquely rearward from the tip portion M4.

The tubular member 10 is located inside the tip opening 2*b* of the front tube 2. For example, the tubular member 10 is in contact with a part of the inner surface 2*k* (second inner surfaces 2*k*2). When viewed along the axial direction D1, the tubular member 10 has a flattened shape. As one example, when viewed along the axial direction D1, the tubular member 10 has a rectangular shape with rounded corners. The tubular member 10 includes a holding portion 11 that holds the application material M in the tube hole 10*c*.

The holding portion 11 has a protruding shape protruding from an inner peripheral surface 10*d* of the tubular member 10 that defines the tube hole 10*c*. When viewed along the axial direction D1, the holding portion 11 has a triangular shape. A part (for example, a top portion) of the holding portion 11 may bite into the flattened surface M1 of the application material M. In this manner, the holding portion 11 holds the application material M by coming into contact with the application material M.

For example, the tubular member 10 includes a plurality of the holding portions 11. The plurality of holding portions 11 are arranged along the major axis direction D2. For example, one of a pair of the holding portions 11 arranged along the major axis direction D2 is disposed on one side when viewed from the reference line A, and the other of the pair of holding portions 11 arranged along the major axis direction D2 is disposed on the other side when viewed from the reference line A. The pair of holding portions 11 arranged along the major axis direction D2 may be disposed at positions that are symmetric to each other with respect to the reference line A.

A plurality of the holding portions 11 are arranged along the minor axis direction D3. Accordingly, the application material M is sandwiched between a pair of the holding portions 11 arranged along the minor axis direction D3. By disposing the holding portions 11 as described above, the application material M can be firmly held in the tube hole 10*c* of the tubular member 10. However, the shape, number and disposition mode of the holding portions 11 can be changed as appropriate. The tubular member 10 will be described in detail later.

Figure 5A:
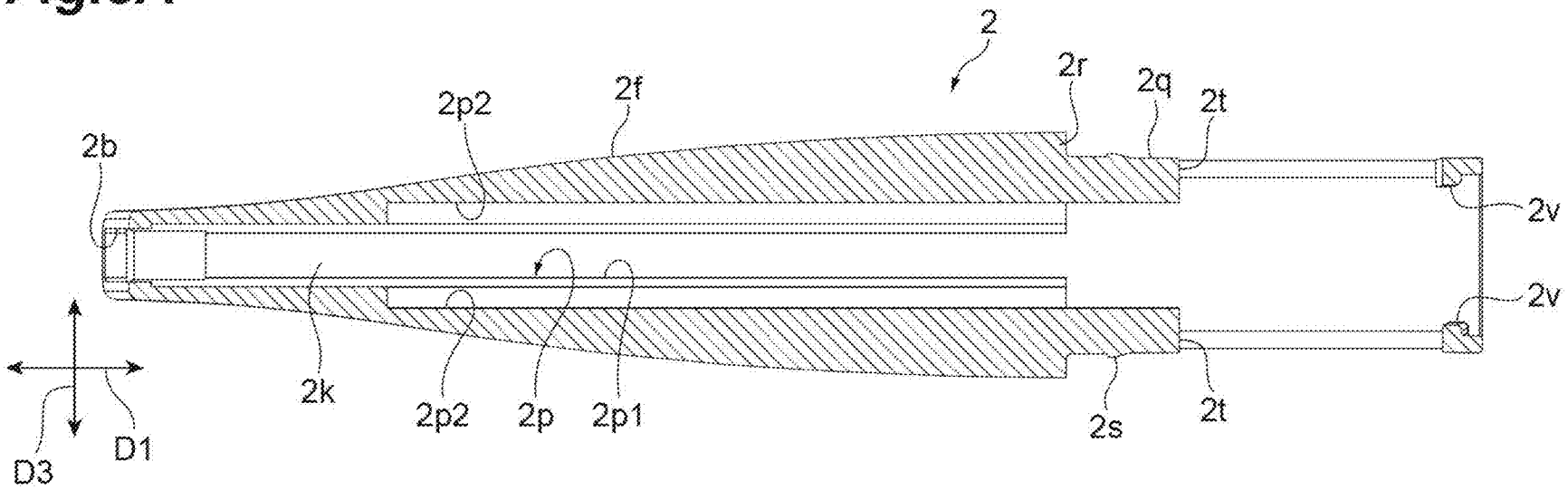
FIG. 5A is a cross-sectional view of a front tube of the application container of FIG. 1A.
Figure 5B:
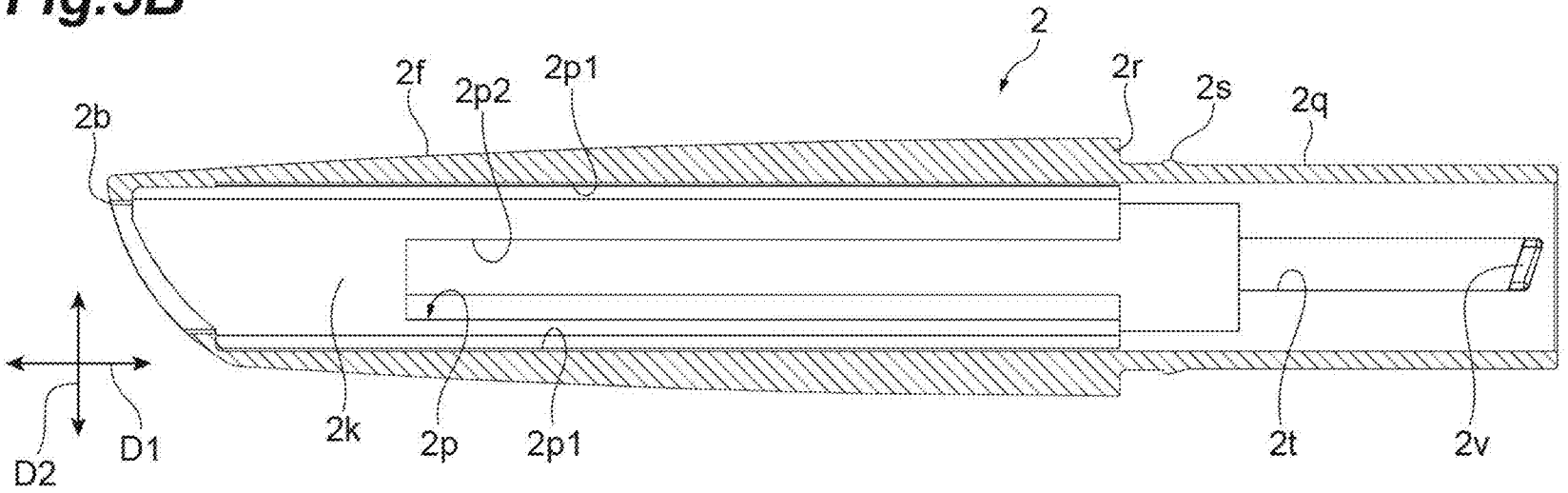
FIG. 5B is another cross-sectional view of the front tube of the application container of FIG. 1A.

FIG. 5A is a cross-sectional view of the front tube 2 when taken along a plane extending along the axial direction D1 and the minor axis direction D3. FIG. 5B is a cross-sectional view of the front tube 2 when taken along a plane extending along the axial direction D1 and the major axis direction D2. As shown in FIGS. 3, 5A, and 5B, the front tube 2 includes a recess 2*p* formed as the inner surface 2*k*. The recess 2*p* includes a first recess 2*p*1 recessed in the major axis direction D2, and a second recess 2*p*2 recessed in the minor axis direction D3.

The recesses 2*p* include a pair of the first recesses 2*p*1 arranged along the major axis direction D2, and a pair of the second recesses 2*p*2 arranged along the minor axis direction D3. The recess 2*p* has a cross shape in a cross section orthogonal to the axial direction D1. The tubular member 10 engages with the recess 2*p* in the rotation direction. Accordingly, the tubular member 10 engages with the front tube 2 to be rotatable synchronously therewith.

The front tube 2 includes a tube portion 2*q* extending along the axial direction D1 behind the tapered surface 2*f*. For example, the tube portion 2*q* has a cylindrical shape. The tube portion 2*q* is reduced in diameter from a step portion 2*r* located at a rear end of the tapered surface 2*f*. The tube portion 2*q* includes a protrusion 2*s* that protrudes to the radial outside of the front tube 2, and that engages with an inner surface 3*b* of the rear tube 3 in the axial direction.

By engaging the protrusion 2*s* with the inner surface 3*b*, the front tube 2 is engaged with the rear tube 3 to be non-movable in the axial direction and to be rotatable relative thereto. The tube portion 2*q* has a through-hole 2*t* penetrating through the front tube 2 in the radial direction. For example, when viewed from the radial outside of the front tube 2, the through-hole 2*t* has a rectangular shape. The tube portion 2*q* has, for example, a pair of the through-holes 2*t*, and the pair of through-holes 2*t* are arranged along the radial direction of the front tube 2.

The front tube 2 includes a first female screw 2*v* inside the front tube 2. The first female screw 2*v* is, for example, a projection protruding from the inner surface 2*k* and extending in a direction inclined with respect to the rotation direction. For example, the first female screw 2*v* is located at an end portion on the rear side of the through-hole 2*t*. The front tube 2 includes, for example, a plurality of the first female screws 2*v*, and the plurality of first female screws 2*v* are arranged along the radial direction of the front tube 2.

Figure 6A:
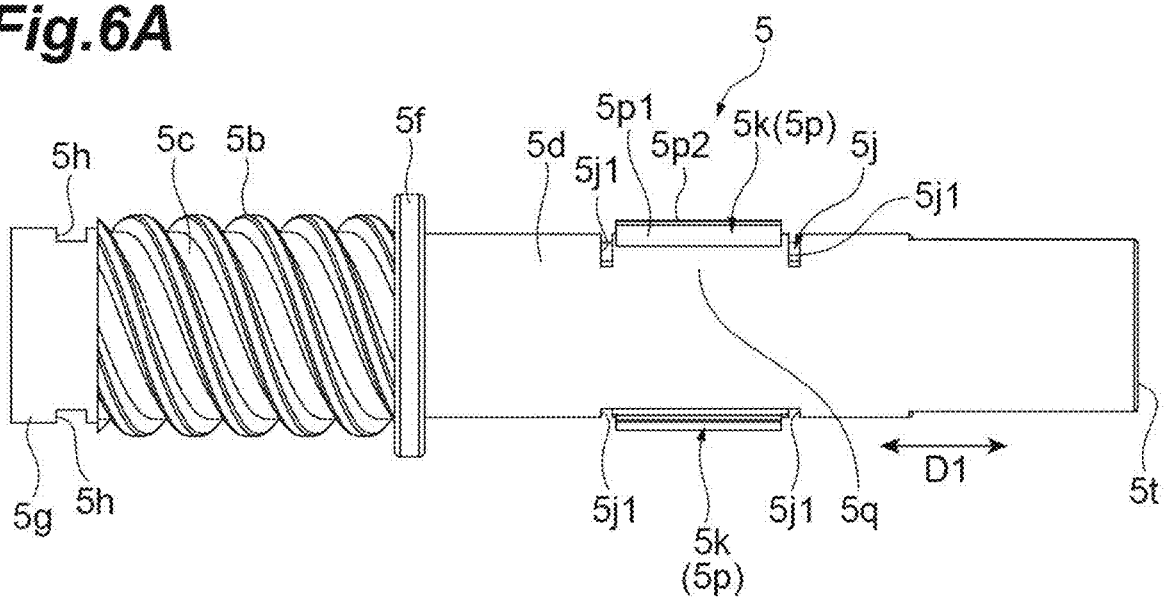
FIG. 6A is a side view showing a screw tube of the application container of FIG. 1A.
Figure 6B:
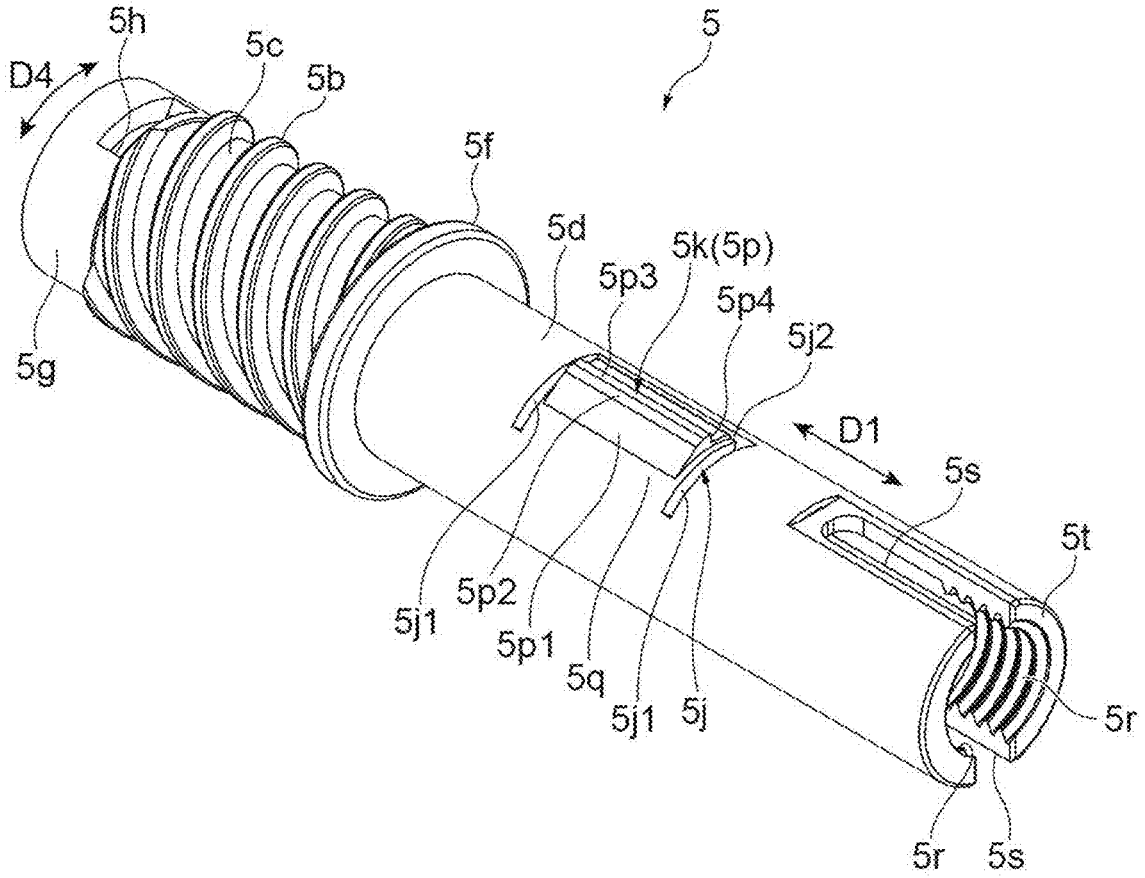
FIG. 6B is a perspective view showing the screw tube of FIG. 6A.

FIG. 6A is a side view showing the screw tube 5. FIG. 6B is a perspective view showing the screw tube 5. As shown in FIGS. 3, 6A, and 6B, the screw tube 5 is provided inside the rear tube 3. The screw tube 5 includes a first tube portion 5*c* in which a first male screw 5*b* that screws into the first female screws 2*v* of the front tube 2 is formed; a second tube portion 5*d* located behind the first tube portion 5*c*; and a flange portion 5*f* located between the first tube portion 5*c* and the second tube portion 5*d*.

The first male screw 5*b* has a helical shape on an outer peripheral surface of the first tube portion 5*c*. By screwing the first male screw 5*b* into the first female screws 2*v* of the front tube 2, when the screw tube 5 rotates relative to the front tube 2, the screw tube 5 is moved by a certain length along the axial direction D1 with respect to the front tube 2. The flange portion 5*f* is disposed between a rear end 2*w* of the front tube 2 and a protruding portion 3*c* of the rear tube 3 which will be described later.

The feed-out mechanism 15 includes a first screwing portion 16 that advances the screw tube 5 with respect to the front tube 2 through the screwing action between the first female screws 2*v* and the first male screw 5*b* when the screw tube 5 rotates relative to the front tube 2. The first screwing portion 16 includes the first female screws 2*v* and the first male screw 5*b*. The screw tube 5 can be advanced from a position where the flange portion 5*f* comes into contact with the protruding portion 3*c* to a position where the flange portion 5*f* comes into contact with the rear end 2*w* of the front tube 2. The position of the screw tube 5 where the flange portion 5*f* comes into contact with the protruding portion 3*c* is the retreat limit of the screw tube 5, and the position of the screw tube 5 where the flange portion 5*f* comes into contact with the rear end 2*w* is the advance limit of the screw tube 5.

The screw tube 5 accommodates, for example, a part (as one example, a rear end portion) of the tubular member 10. The first tube portion 5*c* includes a tube portion 5*g* located in front of the first male screw 5*b*. The tube portion 5*g* has, for example, a cylindrical shape. For example, the tube portion 5*g* includes a window portion 5*h* penetrating through the tube portion 5*g* in the radial direction of the screw tube 5. The tubular member 10 engages with the window portion 5*h* in the axial direction D1. Accordingly, the tubular member 10 engages with the screw tube 5 to be non-movable in the axial direction and to be rotatable relative thereto.

The second tube portion 5*d* includes a slit 5*j* and a spring portion 5*k* defined by the slit 5*j*. The slit 5*j* includes a pair of first slits 5*j*1 extending in a rotation direction D4, and a second slit 5*j*2 connecting the pair of first slits 5*j*1 to each other. The pair of first slits 5*j*1 are arranged along the axial direction D1. The second slit 5*j*2 extends along the axial direction D1 between end portions of the pair of first slits 5*j*1 in the rotation direction D4. The spring portion 5*k* defined by the pair of first slits 5*j*1 and the second slit 5*j*2 has elasticity in the radial direction of the screw tube 5.

The spring portion 5*k* includes a protrusion 5*p* protruding to the radial outside from the screw tube 5. The protrusion 5*p* has a first inclined surface 5*p*1 extending obliquely from an outer surface 5*q* of the screw tube 5 toward the radial outside; a second inclined surface 5*p*2 extending obliquely from an end portion of the first inclined surface 5*p*1 opposite to the outer surface 5*q* toward the radial outside; a top surface 5*p*3; and a wall surface 5*p*4 extending from the top surface 5*p*3 to the radial inside of the screw tube 5. The spring portion 5*k* is elastically deformable in the radial direction of the screw tube 5 when the protrusion 5*p* comes into contact with the protruding portion 3*c* of the rear tube 3.

The screw tube 5 includes a second female screw 5*r* formed on an inner surface of the screw tube 5. The second female screw 5*r* extends, for example, in a helical shape from a rear end 5*t* of the second tube portion 5*d*. The screw tube 5 includes, for example, a pair of the second female screws 5*r*, and the pair of second female screws 5*r* face each other along the radial direction of the screw tube 5. A region between the pair of second female screws 5*r* in the screw tube 5 serves as a holding portion that holds the movable body 6. A slit 5*s* is formed between the pair of second female screws 5*r*. The screw tube 5 is easily released from a mold due to the slit 5*s* when the screw tube 5 is manufactured by resin molding.

As described above, the second tube portion 5*d* includes the slit 5*s* located between the pair of second female screws 5*r*. The slit 5*s* extends forward from the rear end 5*t* of the screw tube 5. The second tube portion 5*d* includes, for example, a pair of the slits 5*s*, and the pair of slits 5*s* face each other along the radial direction of the screw tube 5.

Figure 7:
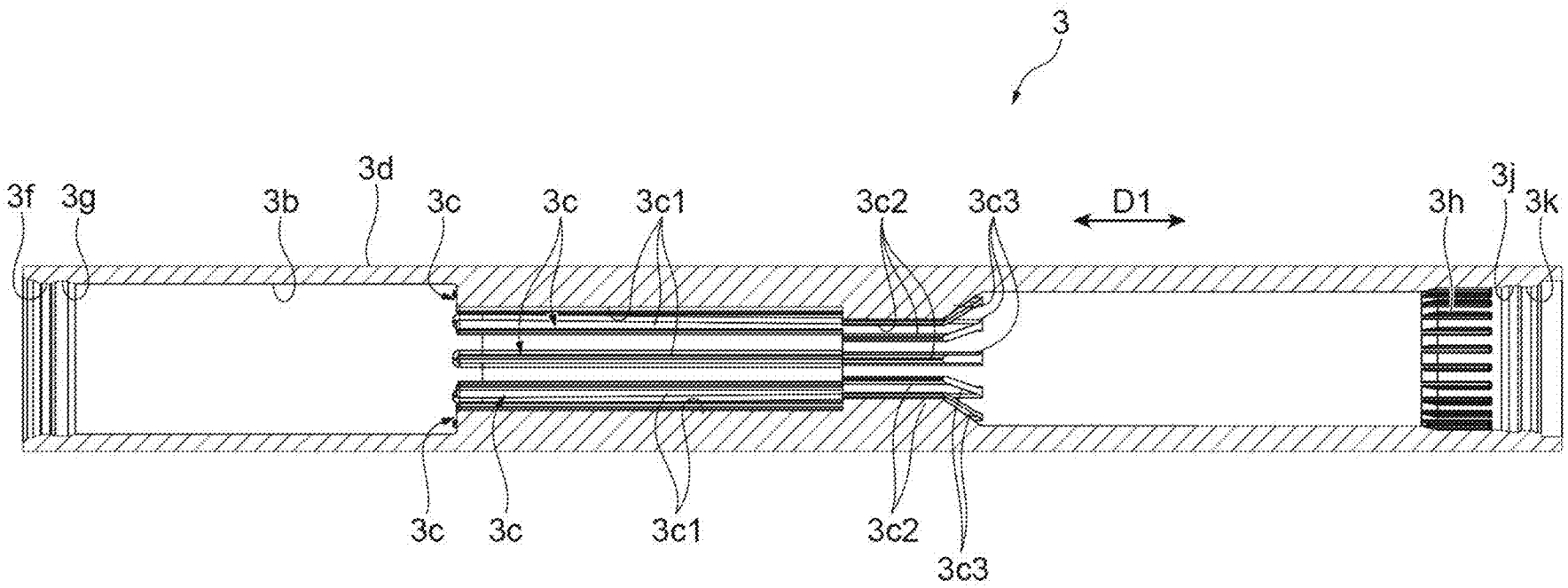
FIG. 7 is a cross-sectional view showing a rear tube of the application container of FIG. 1A.

FIG. 7 is a cross-sectional view of the rear tube 3 when taken along a plane extending along the radial direction and the axial direction D1 of the rear tube 3. As shown in FIGS. 3 and 7, the rear tube 3 has a cylindrical shape having a smooth outer surface 3*d*. The rear tube 3 includes an annular protrusion 3*f* protruding radially inward on the inner surface 3*b*, and an annular recess 3*g* located behind the annular protrusion 3*f* on the inner surface 3*b* and recessed radially outward. The protrusion 2*s* of the front tube 2 which moves rearward over the annular protrusion 3*f* is fitted into the annular recess 3*g*.

For example, the rear tube 3 includes a plurality of the protruding portions 3*c* on the inner surface 3*b*. The plurality of protruding portions 3*c* are arranged along the circumferential direction of the rear tube 3. For example, the protruding portions 3*c* have a plate shape extending in the axial direction D1 and having a thickness in the circumferential direction of the rear tube 3. Each of the protruding portions 3*c* includes a first part 3*cl* protruding to the radial inside of the rear tube 3 on the inner surface 3*b*, and a second part 3*c*2 protruding further to the radial inside than the first part 3*cl* behind the first part 3*cl*. The protruding portion 3*c* further includes an inclined portion 3*c*3 extending obliquely from a rear end of the second part 3*c*2 to be increased radially outward in diameter.

The protrusion 5*p* of the screw tube 5 described above (refer to FIG. 6B) engages with the protruding portions 3*c* in the rotation direction. The screw tube 5 is rotatable only in the one direction with respect to the rear tube 3. More specifically, the screw tube 5 is rotatable with respect to the rear tube 3 in the one direction (counterclockwise in FIG. 6B) in which the first inclined surface 5*p*1 of the protrusion 5*p* comes into contact with the protruding portion 3*c*.

On the other hand, the screw tube 5 does not rotate with respect to the rear tube 3 in the opposite direction (clockwise in FIG. 6B) in which the wall surface 5*p*4 of the protrusion 5*p* comes into contact with the protruding portion 3*c*. Namely, when the screw tube 5 attempts to rotate in the opposite direction with respect to the rear tube 3, the wall surface 5*p*4 comes into contact with the protruding portion 3*c*, so that the rotation of the screw tube 5 is restricted.

The rear tube 3 includes a knurling 3*h* located behind the protruding portions 3*c*; an annular recess 3*j* located behind the knurling 3*h*; and an annular protrusion 3*k* located behind the annular recess 3*j*. The tail plug 8 engages with the knurling 3*h*, the annular recess 3*j*, and the annular protrusion 3*k*. By engaging the tail plug 8 with the knurling 3*h*, the annular recess 3*j*, and the annular protrusion 3*k*, the tail plug 8 is engaged with the rear tube 3 to be non-movable in the axial direction and to be rotatable synchronously therewith.

The tail plug 8 includes a first holding portion 8*b* that holds the movable body 6; an engaging portion 8*c* that engages with the knurling 3*h*, the annular recess 3*j*, and the annular protrusion 3*k* of the rear tube 3; a flange portion 8*d* exposed to the outside of the application container 1; and a second holding portion 8*f* that holds the applicator 9. The applicator 9 protrudes rearward from the second holding portion 8*f*.

The second holding portion 8*f* includes an outer tube portion 8*h* that engages with the cap 4; an inner tube portion 8*j* located on the radial inside of the outer tube portion 8*h*; and a plurality of ribs 8*k* located between the outer tube portion 8*h* and the inner tube portion 8*j*. The inner tube portion 8*j* includes a hole portion 8*g* into which the applicator 9 is inserted. The applicator 9 is inserted into the hole portion 8*g*, so that the second holding portion 8*f* holds the applicator 9. The flange portion 8*d* is located between the engaging portion 8*c* and the second holding portion 8*f*.

The engaging portion 8*c* has, for example, a columnar shape. The engaging portion 8*c* includes an annular protrusion 8*p* that engages with the annular recess 3*j* of the rear tube 3 in the axial direction D1, and a protrusion 8*q* that engages with the knurling 3*h* of the rear tube 3 in the rotation direction. The first holding portion 8*b* has a rod shape. The first holding portion 8*b* protrudes forward from the engaging portion 8*c*. For example, movable body 6 has a tubular shape, and the first holding portion 8*b* is inserted into the movable body 6.

Figure 8A:
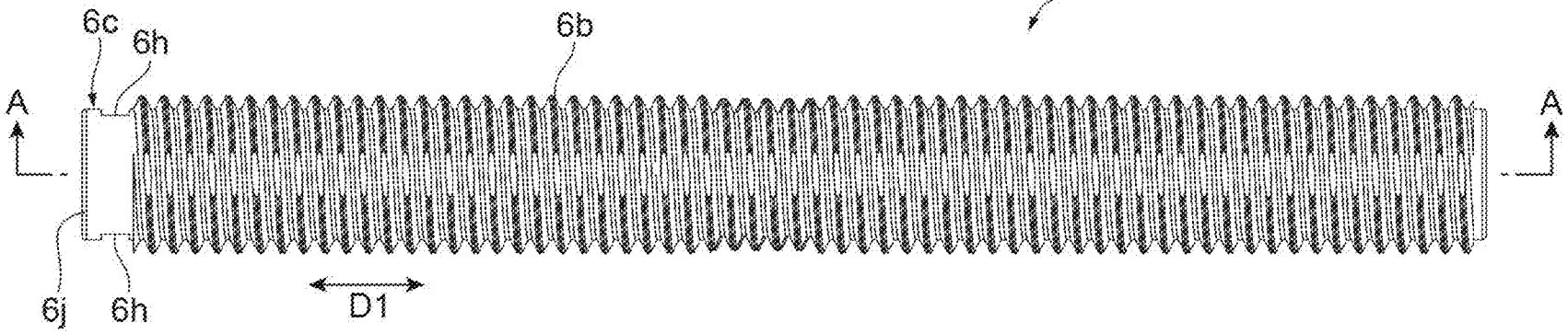
FIG. 8A is a side view showing a movable body of the application container of FIG. 1A.
Figure 8B:
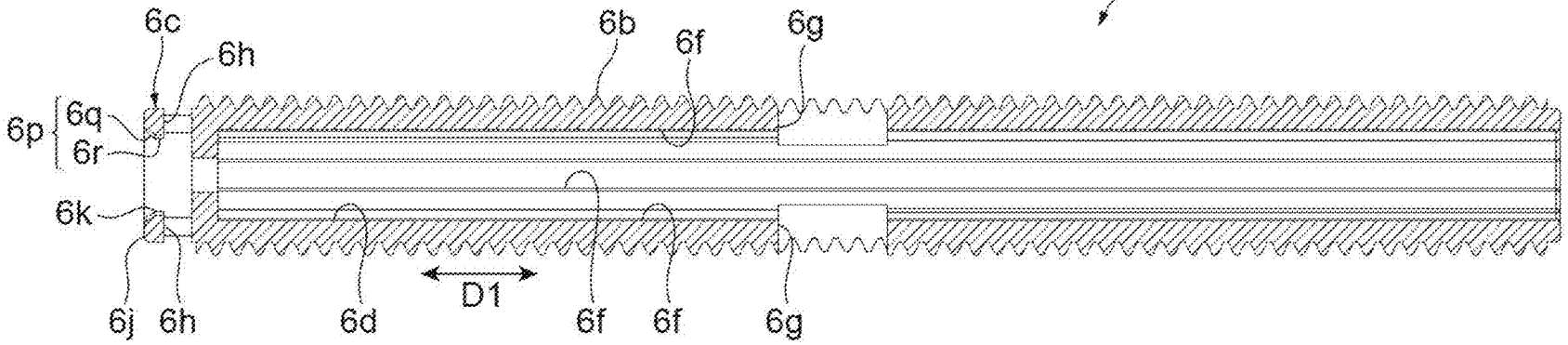
FIG. 8B is a cross-sectional view taken along line A-A of FIG. 8A.

FIG. 8A is a side view showing the movable body 6. FIG. 8B is a cross-sectional view taken along line A-A of FIG. 8A. As shown in FIGS. 3, 8A, and 8B, the movable body 6 includes a second male screw 6*b* that screws into the second female screws 5*r* of the screw tube 5 described above. The feed-out mechanism 15 includes a second screwing portion 17 that advances the movable body 6 with respect to the screw tube 5 through the screwing action between the second female screws 5*r* and the second male screw 6*b*. The second screwing portion 17 includes the second female screws 5*r* and the second male screw 6*b*.

The movable body 6 includes a recess 6*f* on an inner surface 6*d*, the recesses of being recessed radially outward and extending in the axial direction D1. The movable body 6 includes a plurality of the recesses 6*f*, and the plurality of recesses 6*f* are arranged in the circumferential direction. The first holding portion 8*b* of the tail plug 8 engages with the recesses 6*f* in the rotation direction. By engaging the first holding portion 8*b* with the recesses 6*f* in the rotation direction, the tail plug 8 is engaged with the movable body 6 to be rotatable synchronously therewith. For example, the movable body 6 includes a window portion 6*g* penetrating through the movable body 6 in the radial direction. The movable body 6 includes a pair of the window portions 6*g*, and the pair of window portions 6*g* are arranged along the radial direction of the movable body 6. The first holding portion 8*b* located inside the movable body 6 is visible through the window portions 6*g*.

The movable body 6 includes a coupling portion 6*c*, which is coupled to the pressing member 7, in front of the second male screw 6*b*. The coupling portion 6*c* has, for example, a tubular shape. The coupling portion 6*c* includes a hole portion 6*k* recessed rearward from a front end 6*j* of the movable body 6, and a through-hole 6*h* penetrating through the coupling portion 6*c* in the radial direction. The coupling portion 6*c* includes a pair of the through-holes 6*h*, and the pair of through-holes 6*h* are arranged along the radial direction. The hole portion 6*k* communicates with the through-holes 6*h*, and the pressing member 7 engages with the hole portion 6*k* and the through-holes 6*h*. By engaging the pressing member 7 with the hole portion 6*k* and the through-holes 6*h*, the movable body 6 is engaged with the pressing member 7 to be non-movable in the axial direction and to be rotatable relative thereto.

Figure 9A:
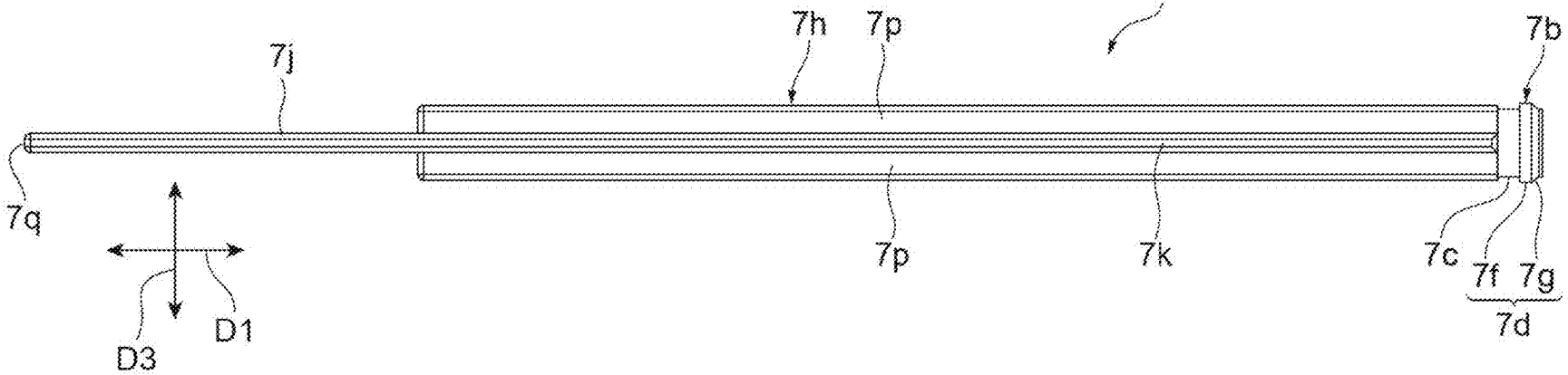
FIG. 9A is a side view showing a pressing member of the application container of FIG. 1A.
Figure 9B:
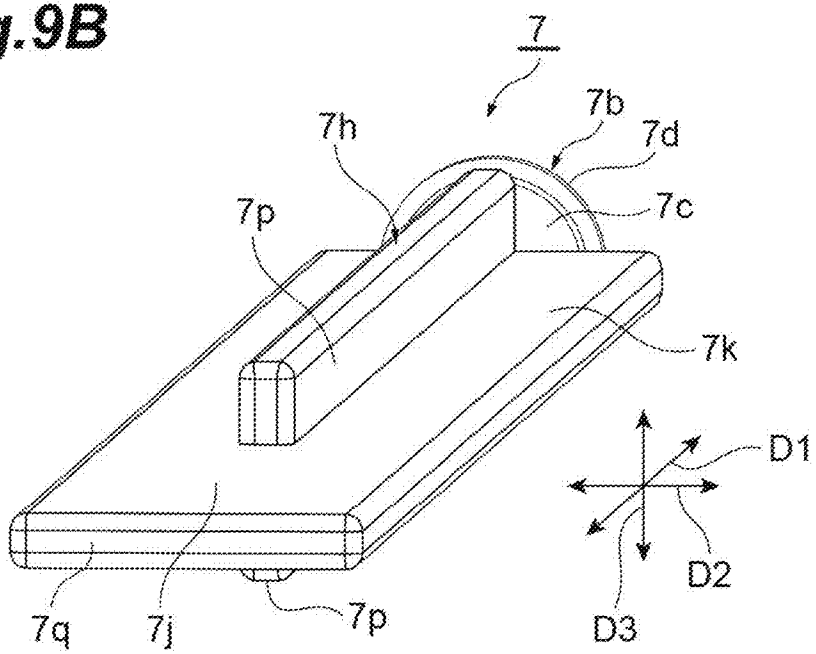
FIG. 9B is a perspective view showing the pressing member of FIG. 9A.
Figure 10:
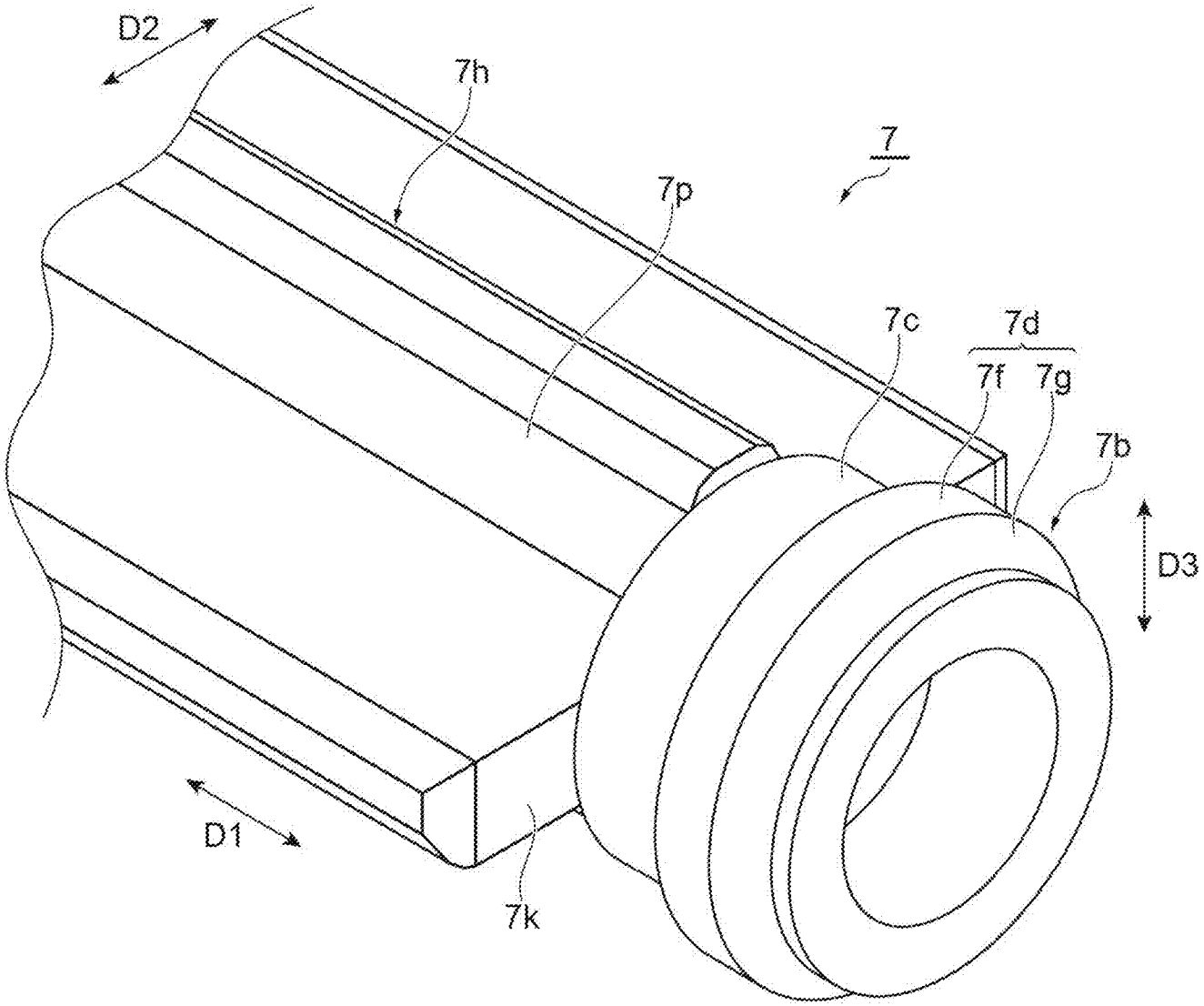
FIG. 10 is an enlarged perspective view of a rear end portion of the pressing member of FIG. 9A.

FIG. 9A is a side view showing the pressing member 7. FIG. 9B is a perspective view showing the pressing member 7. FIG. 10 is an enlarged perspective view of a rear end portion 7*b* of the pressing member 7. As shown in FIGS. 8B, 9A, 9B, and 10, the rear end portion 7*b* of the pressing member 7 is a portion that engages with the movable body 6, and has, for example, a stepped cylindrical shape.

The rear end portion 7*b* includes an outer surface 7*c* having a cylindrical shape, and an annular protrusion 7*d* protruding on the outer surface 7*c*. The annular protrusion 7*d* has a top surface 7*f* extending in the circumferential direction, and an inclined surface 7*g* extending rearward and obliquely downward with respect to the top surface 7*f*. The coupling portion 6*c* of the movable body 6 has an inner surface 6*p* that defines the hole portion 6*k*.

The inner surface 6*p* has an inclined surface 6*q* extending obliquely to the radial inside as the inner surface 6*p* extends away from the front end 6*j*, and a top surface 6*r* extending rearward from an end portion of the inclined surface 6*q* opposite to the front end 6*j*. When the rear end portion 7*b* of the pressing member 7 is inserted into the hole portion 6*k*, the annular protrusion 7*d* moves rearward over the inner surface 6*p*, and engages with the through-holes 6*h* in the axial direction D1.

As shown in FIGS. 3, 9A, 9B, and 10, the pressing member 7 includes a rotation stop portion 7*h* that functions as a rotation stopper for the tubular member 10, and a push-out portion 7*j* that is located in front of the rotation stop portion 7*h*, and that pushes out the application material M. The rotation stop portion 7*h* extends in the axial direction D1 inside the screw tube 5.

The pressing member 7 includes a first plate-shaped portion 7*k* extending in the axial direction D1 and the major axis direction D2 and having a thickness in the minor axis direction D3, and a second plate-shaped portion 7*p* intersecting the first plate-shaped portion 7*k*. The second plate-shaped portion 7*p* extends in the axial direction D1 and the minor axis direction D3, and has a thickness in the major axis direction D2.

The pressing member 7 includes a pair of the second plate-shaped portions 7*p*, and the pair of second plate-shaped portions 7*p* are arranged along the minor axis direction D3. The second plate-shaped portions 7*p* protrude upward and downward with respect to the center of the first plate-shaped portion 7*k* in the major axis direction D2. Therefore, when viewed from the front, the pressing member 7 has a cross shape.

For example, a portion of the pressing member 7 in which the first plate-shaped portion 7*k* and the second plate-shaped portions 7*p* are provided is the rotation stop portion 7*h*, and a portion of the pressing member 7 in which only the first plate-shaped portion 7*k* is provided is the push-out portion 7*j*. The rotation stop portion 7*h* engages with the tubular member 10 in the rotation direction inside the screw tube 5. Accordingly, the rotation of the pressing member 7 with respect to the tubular member 10 is inhibited.

For example, a length of the push-out portion 7*j* in the axial direction D1 is shorter than a length of the rotation stop portion 7*h* in the axial direction D1. The push-out portion 7*j* is located in front of the rotation stop portion 7*h*. The push-out portion 7*j* has a tip surface 7*q* that comes into contact with the application material M. For example, the shape and size of the tip surface 7*q* are the same as the shape and size of a rear end surface M5 of the application material M. Each of the tip surface 7*q* and the rear end surface M5 has a flattened shape having a major axis extending in the major axis direction D2 and a minor axis extending in the minor axis direction D3.

Figure 11A:
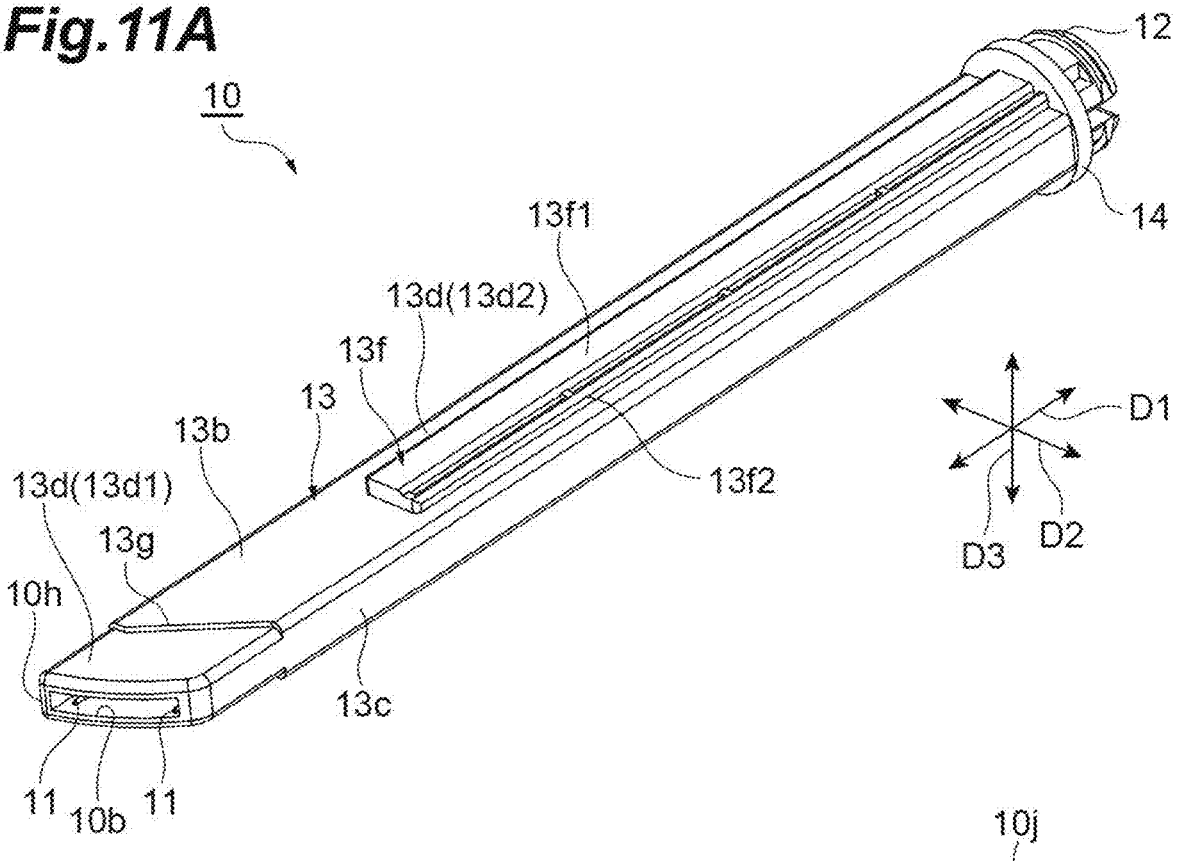
FIG. 11A is a perspective view showing the tubular member of the application container of FIG. 1A.
Figure 11B:
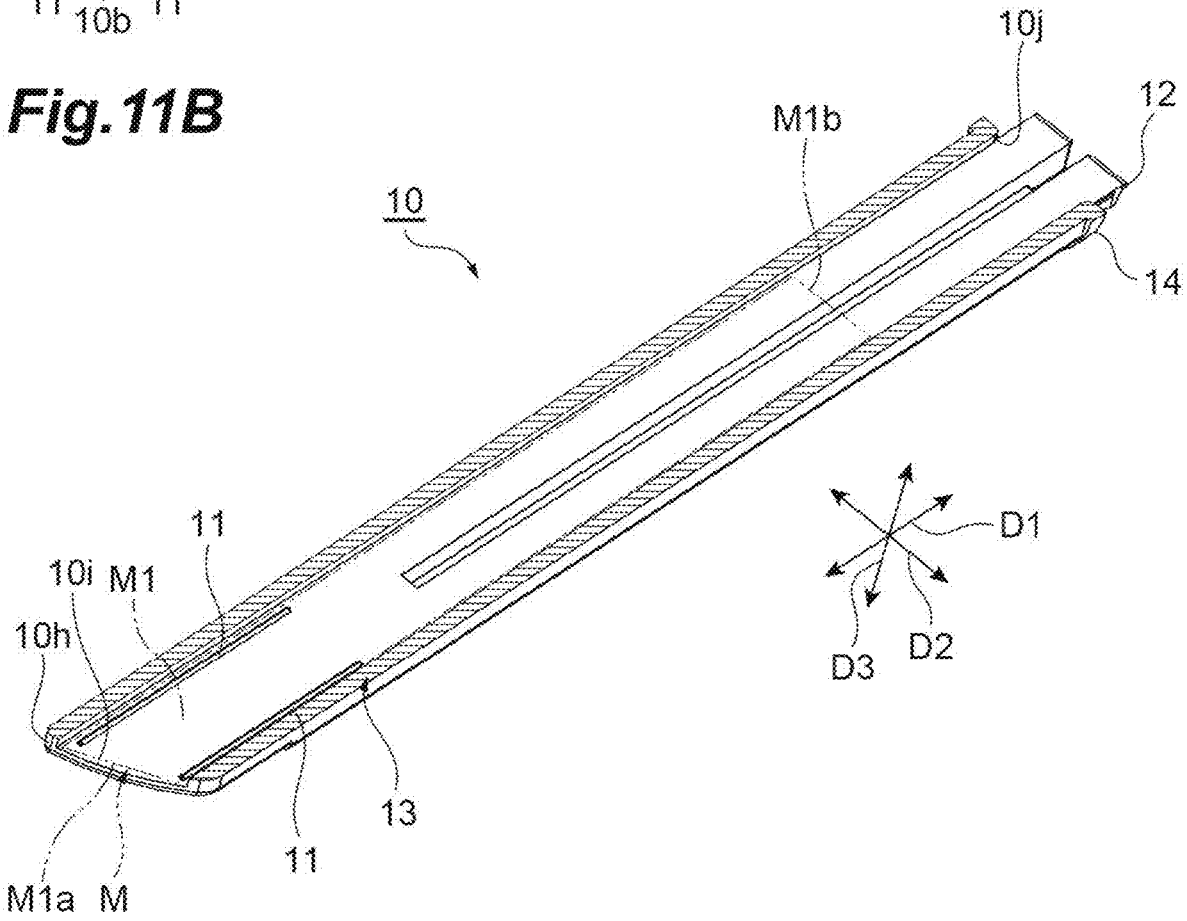
FIG. 11B is a partial cross-sectional view showing the tubular member of FIG. 11A.

Next, the tubular member 10 will be described in more detail. FIG. 11A is a perspective view showing the tubular member 10. FIG. 11B is a cross-sectional perspective view showing the tubular member 10 taken along a plane extending in the axial direction D1 and the major axis direction D2. As shown in FIGS. 11A and 11B, the tubular member 10 includes a connecting portion 12 to which the screw tube 5 is connected; a holding tube portion 13 that holds the application material M; and a flange portion 14 located between the connecting portion 12 and the holding tube portion 13.

The shape of the holding tube portion 13 when viewed along the axial direction D1 has a flattened shape having a major axis extending along the major axis direction D2 and a minor axis extending along the minor axis direction D3. As described above, the tubular member 10 includes the holding portions 11 that holds the application material M. The application material M extends along the axial direction D1 on the holding portions 11.

As shown in FIGS. 4 and 11B, the holding portions 11 extend from one end side toward the other end side of the flattened surfaces M1 in the axial direction D1 in a state where the holding portions 11 are in contact with the flattened surfaces M1 of the application material M. The fact that "the holding portions extend from the one end side toward the other end side of the flattened surfaces in the axial direction" refers to the fact that the holding portions extend from the one end side toward the other end side of the flattened surfaces in the axial direction. Namely, the holding portions 11 may be formed adjacent to a first end (e.g., front end 10*i*) of the tube hole (or at first end portions M1*a* of the flattened surfaces M1) and extend toward a second end (e.g., rear end 10*j*) of the tube hole (or toward second end portions M1*b* of the flattened surfaces M1), so as to contact the flattened surfaces M1 of the application material M, along at least a portion of a length of the application material M in the axial direction D1.

The fact that "the holding portions extend from the one end side toward the other end side of the flattened surfaces in the axial direction" may refer to the fact that the holding portions extend linearly from the one end side toward the other end side of the flattened surfaces in the axial direction. In the present example, by setting the holding portions 11 to extend from the one end side (e.g., front end portion) M1*a* toward the other end side (e.g., rear end portion) M1*b* of the flattened surfaces M1 in the axial direction D1, even when the length (thickness) of the application material M in the minor axis direction D3 is short (thin), the application material M can be firmly held.

In the tubular member 10 according to the present example, by forming the holding portions 11 in the tube hole 10*c*, the application material M having a length of 1 mm or less in the minor axis direction D3 can also be firmly held. For example, the length (thickness) of the application material M in the minor axis direction D3 is 0.5 mm or more and 1 mm or less, and a length (width) of the application material M in the major axis direction D2 is 3 mm or more and 4 mm or less.

In the example of FIG. 11B, the holding portions 11 extend linearly from the front end portion M1*a* of the flattened surfaces M1 toward the rear end portion M1*b*. For example, a length of the holding portions 11 in the axial direction D1 is 20% or more and 50% or less of a length of the flattened surfaces M1 in the axial direction D1. However, the length of the holding portions 11 in the axial direction D1 is not limited to the above example, and can be changed as appropriate.

The tubular member 10 includes a tip 10*h*. The tip 10*h* is one end of the tubular member 10 in the axial direction D1, and is located at one end of the tubular member 10 in the major axis direction D2. In the present example, the length of the holding portion 11 in the axial direction D1 located on the one side in the major axis direction D2 is different from the length of the holding portion 11 in the axial direction D1 located on the other side in the major axis direction D2. More specifically, the length of the holding portion 11 located on a tip 10*h* side of the tubular member 10 is longer than the length of the holding portion 11 located on an opposite side of the tubular member 10 from the tip 10*h*.

Figure 12:
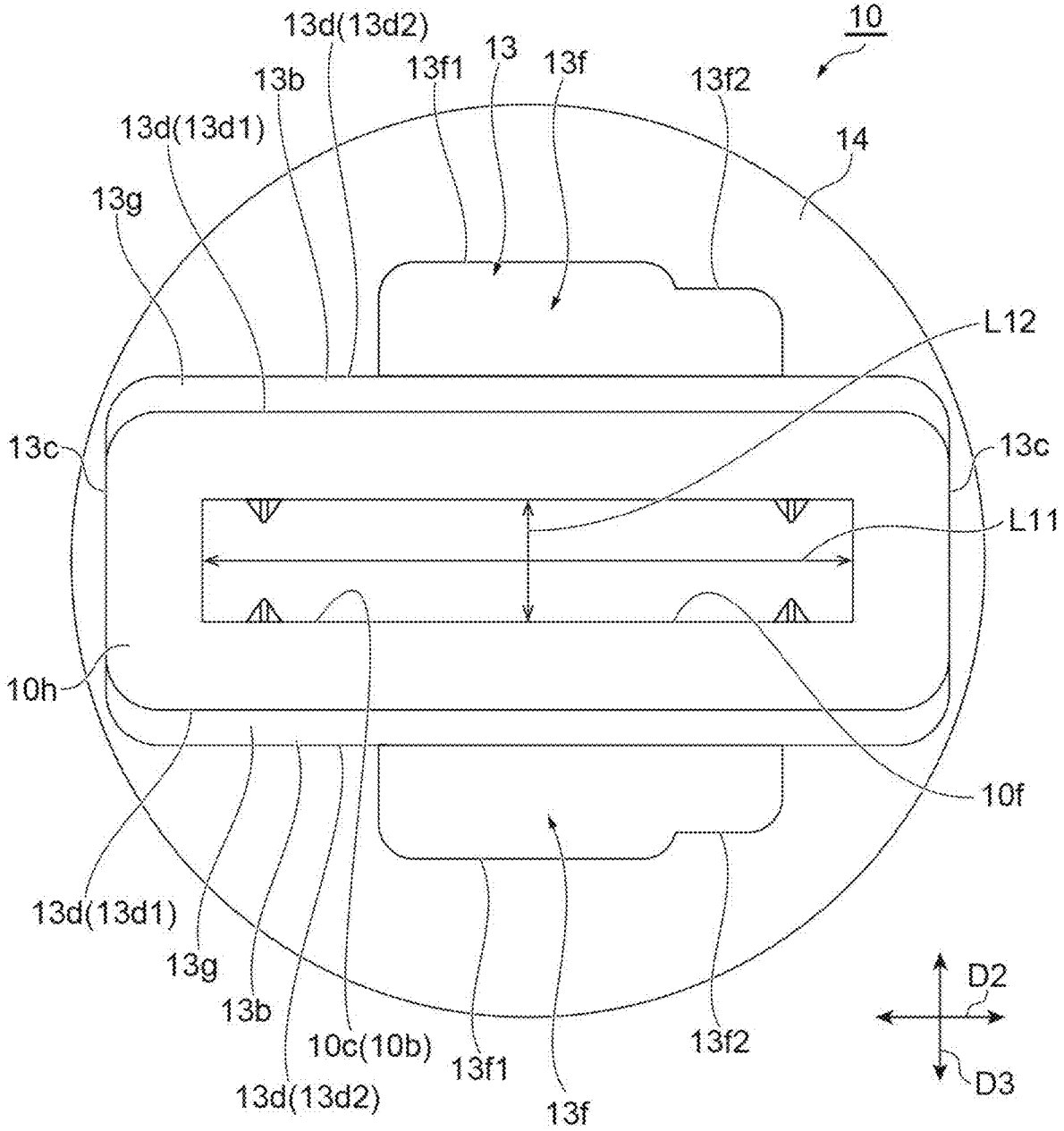
FIG. 12 is a front view showing the tubular member of FIG. 11A.

FIG. 12 is a view showing the tubular member 10 when viewed from the front. As shown in FIGS. 11A, 11B, and 12, the shape of the tube hole 10*c* of the holding tube portion 13 when viewed from the front is a flattened shape having the major axis L11 and the minor axis L12. As one example, the shape of the tube hole 10*c* of the holding tube portion 13 when viewed from the front is a rectangular shape having long sides extending in the major axis direction D2 and short sides extending in the minor axis direction D3.

For example, the holding tube portion 13 includes first side portions 13*b* extending in the axial direction D1 and the major axis direction D2, and second side portions 13*c* extending in the axial direction D1 and the minor axis direction D3. The holding tube portion 13 includes a pair of the second side portions 13*c* arranged along the major axis direction D2. For example, the second side portions 13*c* have a flat shape.

Each of the first side portions 13*b* includes a flat surface 13*d* extending in the axial direction D1 and the major axis direction D2, and a protrusion 13*f* protruding from the flat surface 13*d*. The flat surface 13*d* includes a first flat surface 13*d*1 located on the tip 10*h* side of the tubular member 10, and a second flat surface 13*d*2 extending rearward from the first flat surface 13*d*1. The second flat surface 13*d*2 is located closer to an end portion side in the minor axis direction D3 than the first flat surface 13*d*1. The holding tube portion 13 includes a step portion 13*g* located between the first flat surface 13*d*1 and the second flat surface 13*d*2.

The tubular member 10 engages with the front tube 2 in the rotation direction by entering the recess 2*p* of the front tube 2 described above (refer to FIGS. 5A and 5B). More specifically, the second side portions 13*c* of the holding tube portion 13 enter the first recesses 2*p*1, and the protrusions 13*f* of the holding tube portion 13 enter the second recess 2*p*2, so that the tubular member 10 engages with the front tube 2 in the rotation direction.

The holding tube portion 13 includes a pair of the protrusions 13*f*, and the pair of protrusions 13*f* are arranged along the minor axis direction D3. Accordingly, when viewed from the front, the tubular member 10 has a cross shape. Each of the protrusions 13*f* includes a first part 13*f*1 located on the one side in the major axis direction D2, and a second part 13*f*2 located on the other side in the major axis direction D2 and having a lower protrusion height than the first part 13*f*1.

A length of the first part 13*f*1 in the major axis direction D2 is longer than a length of the second part 13*f*2 in the major axis direction D2. The center position of the protrusion 13*f* in the major axis direction D2 is shifted further to one side (the right side in FIG. 12) in the major axis direction D2 than the center position of the tubular member 10 in the major axis direction D2. The center position of the second recesses 2*p*2 in the major axis direction D2 is shifted further to one side (the lower side in FIG. 5B) in the major axis direction D2 than the center position of the front tube 2 in the major axis direction D2. Therefore, the insertion of the tubular member 10 into the front tube 2 with the orientation of the tubular member 10 in the minor axis direction D3 reversed can be avoided.

Figure 13:
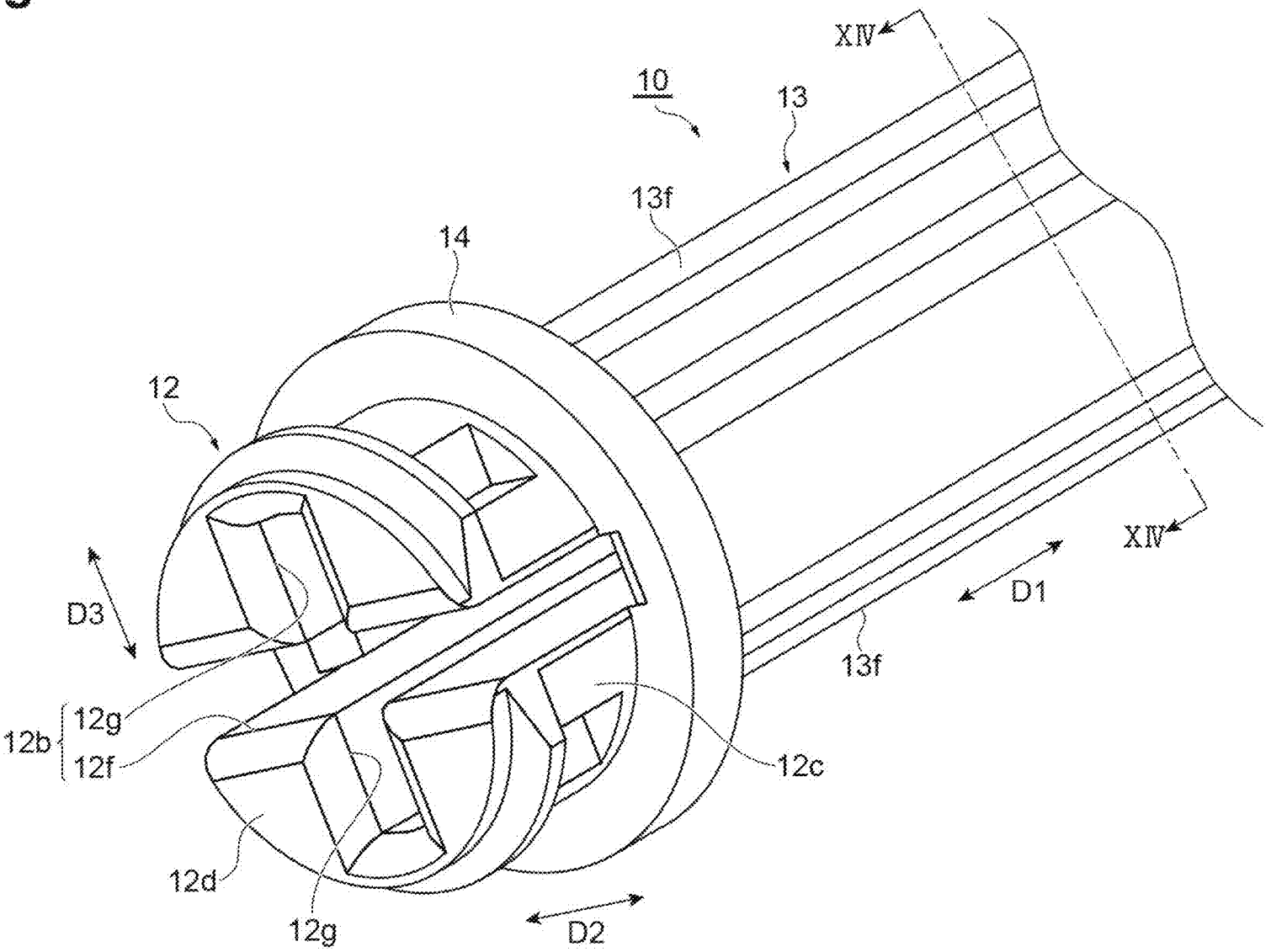
FIG. 13 is an enlarged perspective view of a rear end portion of the tubular member of FIG. 11A.

FIG. 13 is an enlarged perspective view of the connecting portion 12 and the flange portion 14. As shown in FIG. 13, the connecting portion 12 protrudes from the flange portion 14 in a direction opposite to the holding tube portion 13 (rearward). The connecting portion 12 includes a protruding portion 12*c* protruding rearward from the flange portion 14, and a hole portion 12*b* which extends forward from a rear end 12*d* of the protruding portion 12*c* and through which the pressing member 7 is passed.

The hole portion 12*b* includes a first hole portion 12*f* penetrating through the protruding portion 12*c* in the major axis direction D2, and a second hole portion 12*g* intersecting the first hole portion 12*f* and extending along the minor axis direction D3. The second hole portion 12*g* protrudes in the minor axis direction D3 from the center of the first hole portion 12*f* in the major axis direction D2. For example, when viewed from the rear, the first hole portion 12*f* and the second hole portion 12*g* form a cross shape.

The pressing member 7 is inserted into the hole portion 12*b* from the rear. More specifically, the first plate-shaped portion 7*k* of the pressing member 7 (refer to FIG. 9B) is inserted into the first hole portion 12*f*, and the second plate-shaped portions 7*p* of the pressing member 7 are inserted into the second hole portion 12*g*. By inserting the pressing member 7 into the hole portion 12*b* in this manner, the pressing member 7 is engaged with the tubular member 10 in the rotation direction (to be rotatable synchronously therewith).

Figure 14:
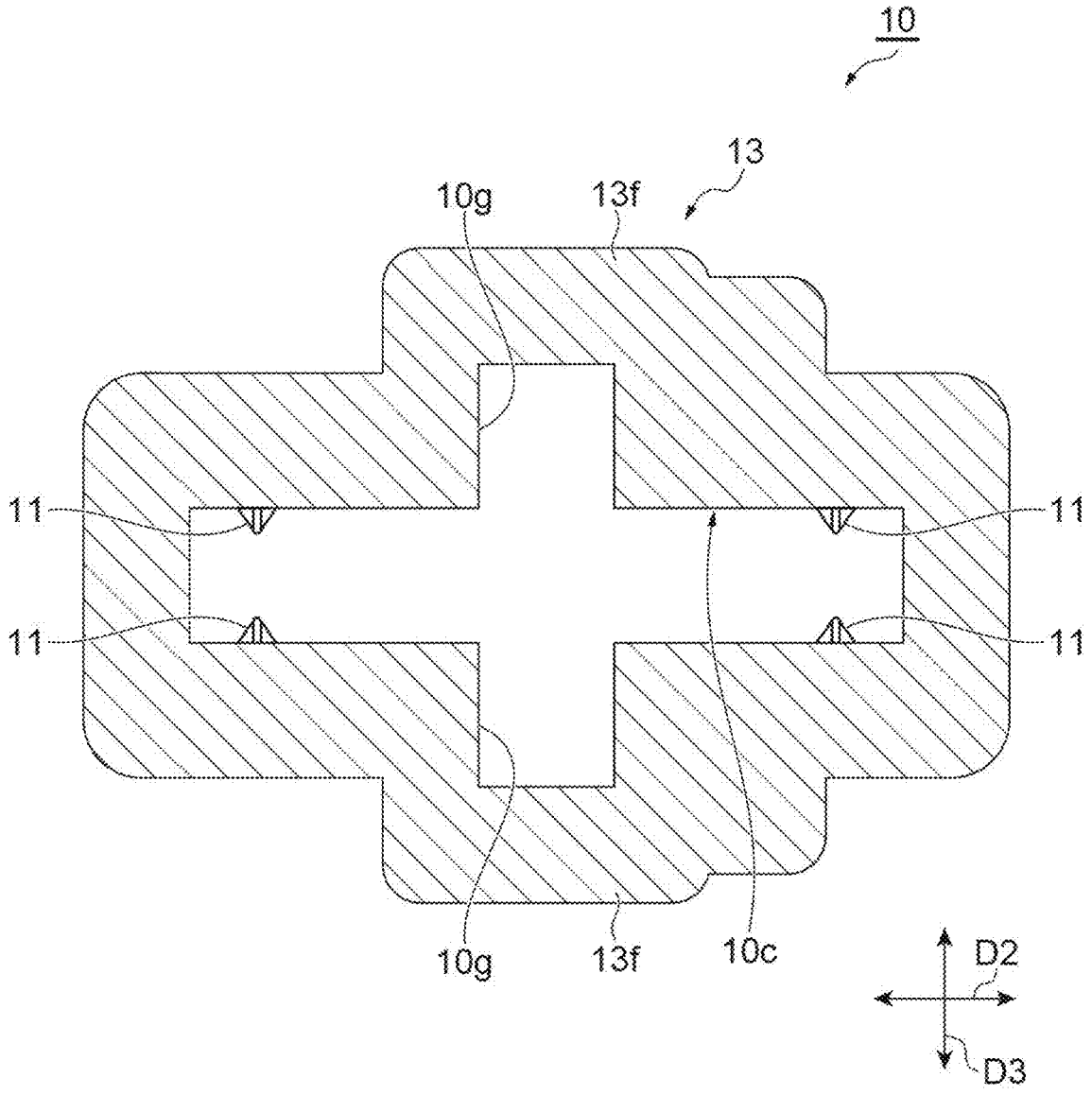
FIG. 14 is a cross-sectional view of the tubular member illustrated in FIG. 13, taken in a plane orthogonal to an axial direction, along line XIV-XIV.

FIG. 14 is a cross-sectional view of parts of the holding tube portion 13 in which the protrusions 13*f* are formed, when taken along a plane orthogonal to the axial direction D1. As shown in FIGS. 12 and 14, the tube hole 10*c* of the tubular member 10 includes a first tube hole portion 10*f* extending rearward from the tip 10*h*, and a second tube hole portion 10*g* located behind the first tube hole portion 10*f* and inside the parts of the tubular member 10 in which the protrusions 13*f* are formed.

The cross section of the first tube hole portion 10*f* when taken along a plane orthogonal to the axial direction D1 has a flattened shape extending in the major axis direction D2 and the minor axis direction D3. The cross section of the second tube hole portion 10*g* when taken along a plane orthogonal to the axial direction D1 has a cross shape. For example, a part (front part) of the application material M is passed through the first tube hole portion 10*f*, and the remaining part (rear part) of the application material M and the pressing member 7 are passed through the second tube hole portion 10*g*. Accordingly, the application material M and the pressing member 7 can be advanced in the tube hole 10*c*.

Next, the operation of each component of the application container 1 when the application container 1 is used will be described with reference to FIGS. 1A, 1B, 2A to 2C, and 3. First, when the rear tube 3 rotates relative to the front tube 2 in the one direction (for example, clockwise), the screw tube 5 rotates synchronously with the rear tube 3, and the screwing action between the first male screw 5*b* of the screw tube 5 and the first female screws 2*v* of the front tube 2 (first screwing portion 16) works, so that the screw tube 5 advances with respect to the front tube 2.

When the screw tube 5 advances with respect to the front tube 2, the tubular member 10 and the application material M advance together with the screw tube 5. The tubular member 10 and the application material M that advance protrude forward from the tip opening 2*b* of the front tube 2. Then, when the rear tube 3 rotates relative to the front tube 2 in the one direction in a state where the screw tube 5 advances and reaches the advance limit, the rear tube 3, the tail plug 8, and the movable body 6 rotate relative to the screw tube 5 in the one direction, and the screwing action between the second female screws 5*r* of the screw tube 5 and the second male screw 6*b* of the movable body 6 (second screwing portion 17) works.

When the screwing action of the second screwing portion 17 works, the movable body 6, the pressing member 7, and the application material M advance with respect to the screw tube 5 and the tubular member 10. Accordingly, the application material M is fed out forward with respect to the tubular member 10, and the application material M is ready for use. In addition, when the rear tube 3 rotates in the opposite direction (for example, counterclockwise) of the one direction with respect to the front tube 2, the screw tube 5 rotates synchronously with the rear tube 3, and the screwing action between the first male screw 5*b* of the screw tube 5 and the first female screws 2*v* of the front tube 2 (first screwing portion 16) works, so that the screw tube 5 retreats with respect to the front tube 2.

When the screw tube 5 retreats with respect to the front tube 2, the tubular member 10 and the application material M retreat together with the screw tube 5. As described above, since the screw tube 5 does not rotate in the opposite direction with respect to the rear tube 3 (the wall surface 5*p*4 comes into contact with the protruding portion 3*c*), the rear tube 3, the tail plug 8, and the movable body 6 do not rotate relative to the screw tube 5 in the opposite direction. Therefore, since the screwing action of the second screwing portion 17 does not work during rotation in the opposite direction, the application material M is not returned rearward with respect to the tubular member 10.

Next, actions and effects obtained from the application container 1 according to the present example will be described. As shown in FIGS. 3, 4, and 11B, the application container 1 includes the tubular member 10 that accommodates the application material M, and the feed-out mechanism 15 that feeds out the application material M accommodated in the tubular member 10, and the feed-out mechanism 15 causes the application material M to protrude from the tubular member 10 by feeding out the application material M. The shape of the tube hole 10*c* of the tubular member 10 when viewed along the axial direction D1 and the shape of the application material M when viewed along the axial direction D1 are a flattened shape having a major axis and a minor axis.

The application material M has the flattened surfaces M1 extending in the axial direction D1 and the major axis direction D2, and the tubular member 10 includes the holding portions 11 that hold the application material M by coming into contact with the flattened surfaces M1. The holding portions 11 that come into contact with the flattened surfaces M1 of the application material M extend from the one end side toward the other end side of the flattened surfaces M1 in the axial direction D1. Therefore, by setting the holding portions 11 to extend from the one side toward the other side of the flattened surfaces M1 in the axial direction D1 in a state where the holding portions 11 are in contact with the flattened surfaces M1, the holding portions 11 may hold the application material M in a wide range from the one side toward the other side in the axial direction D1. Therefore, even when the holding portions 11 hold the application material M having a flattened shape, since the holding portions 11 hold the application material M in a range from the one side toward the other side of the flattened surfaces M1 in the axial direction D1, deformation and breakage of the application material M can be suppressed.

In the present example, the cross section of the application material M orthogonal to the axial direction D1 has a flattened shape, and the cross section of the tube hole 10*c* orthogonal to the axial direction D1 has a flattened shape from one ends to the other ends of the flattened surfaces M1 in the axial direction D1. Namely, the entirety of the flattened surfaces M1 in the axial direction D1 faces the inner peripheral surface 10*d* of the tube hole 10*c* having a flattened shape. Therefore, since vibration of the application material M in the tube hole 10*c* can be suppressed and the application material M can be firmly held in the tube hole 10*c*, deformation and breakage of the application material M can be more reliably suppressed.

In the present example, the holding portions 11 have a protruding shape protruding toward the flattened surfaces M1. The tubular member 10 includes the plurality of holding portions 11 arranged along the major axis direction D2 and arranged along the minor axis direction D3. The application material M is sandwiched between the plurality of holding portions 11 arranged along the minor axis direction D3. In this case, since the application material M is held in a state where the application material M is sandwiched between the pair of holding portions 11 arranged along the minor axis direction D3, the application material M can be more firmly held by the plurality of holding portions 11. As a result, deformation and breakage of the application material M can be more reliably suppressed.

In the present example, the application container 1 includes the front tube 2 that accommodates the tubular member 10 and that includes the first female screws 2*v* thereinside; the rear tube 3 coupled to the front tube 2 to be rotatable relative thereto; the screw tube 5 provided inside the rear tube 3 and including the first male screw 5*b* that screws into the first female screws 2*v*, and the second female screws 5*r* formed on the inner surface; and the movable body 6 that advances inside the screw tube 5 and that includes the second male screw 6*b* that screws into the second female screws 5*r*.

The feed-out mechanism 15 includes the first screwing portion 16 that advances the screw tube 5 with respect to the front tube 2 through the screwing action between the first male screw 5*b* and the first female screws 2*v* when the screw tube 5 rotates relative to the front tube 2, and the second screwing portion 17 that advances the movable body 6 with respect to the screw tube 5 through the screwing action between the second female screws 5*r* and the second male screw 6*b* when the rear tube 3 rotates relative to the screw tube 5. When the rear tube 3 rotates relative to the front tube 2 in the one direction, the screw tube 5 rotates synchronously with the rear tube 3, and the screw tube 5 advances to the advance limit with respect to the rear tube 3, so that the tubular member 10 and the application material M protrude forward from the front tube 2.

When the rear tube 3 rotates relative to the front tube 2 in the one direction in a state where the screw tube 5 reaches the advance limit, the rear tube 3 rotates relative to the screw tube 5, and the movable body 6 advances with respect to the screw tube 5, so that the application material M is fed out with respect to the tubular member 10. In this case, since the application material M can be advanced together with the tubular member 10 by rotating the rear tube 3 relative to the front tube 2 in the one direction, deformation and breakage of the application material M when the application material M is fed out can be suppressed. In addition, in a state where the screw tube 5 reaches the advance limit and the tubular member 10 and the application material M protrude forward from the front tube 2, the application material M is fed out with respect to the tubular member 10 for the first time. Therefore, since the feed-out amount of the application material M with respect to the tubular member 10 can be reduced, breakage of the application material M when application is performed can be more reliably suppressed.

Next, various additional examples of the application container according to the present disclosure will be described. In the following description of examples, parts or components of the example application containers that are the same as those of the above-described examples are designated by the same reference signs described above, and some of the description thereof may be omitted.

Figure 15:
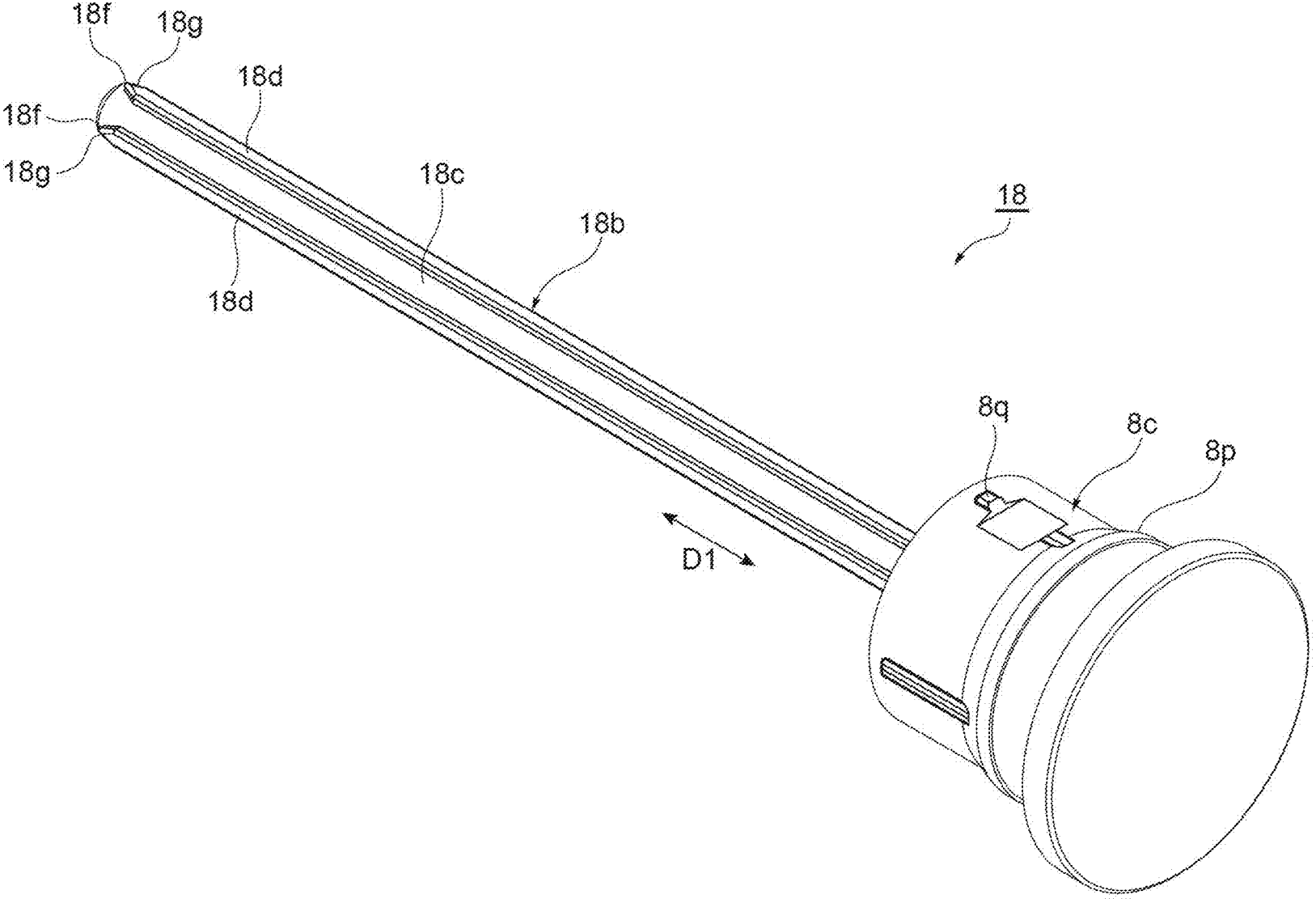
FIG. 15 is a perspective view showing a tail plug of an application container according to another example.

An example application container will be described with reference to FIG. 15. FIG. 15 is a perspective view showing an example tail plug 18. In the above-described examples, the tail plug 8 including the first holding portion 8*b* that holds the movable body 6 and the second holding portion 8*f* that holds the applicator 9 has been described. However, in other examples with reference to FIG. 15, the application container may include the tail plug 18 that does not include the second holding portion 8*f* that holds the applicator 9, instead of the tail plug 8. The application container in FIG. 15 includes the tail plug 18, and does not include the cap 4 and the applicator 9. The application container of FIG. 15 is similar to the application container 1, with some differences in that the application container includes the tail plug 18 instead of the tail plug 8 and does not include the cap 4 and the applicator 9.

The tail plug 18 includes a first holding portion 18*b* that holds the movable body 6. The first holding portion 18*b* includes a rod-shaped portion 18*c* extending forward from the engaging portion 8*c*, and a protrusion 18*d* protruding radially outward from the rod-shaped portion 18*c* and extending along the axial direction D1. The first holding portion 18*b* includes a plurality of the protrusions 18*d*, and the plurality of protrusions 18*d* are arranged in the circumferential direction.

The first holding portion 18*b* enters the movable body 6 from the rear. The protrusions 18*d* engage with the recesses 6*f* of the movable body 6 (refer to FIG. 8B) in the rotation direction. The protrusions 18*d* extend linearly along the axial direction D1, and have a width in the circumferential direction. Each of the protrusions 18*d* includes a front end portion 18*g* where the width of the protrusion 18*d* narrows as the protrusion 18*d* extends toward a front end 18*f* of the protrusion 18*d*. At the front end portion 18*g*, the width of the protrusion 18*d* widens as the protrusion 18*d* extends away from the front end 18*f*. Since each of the protrusions 18*d* includes the front end portion 18*g*, the insertion of the first holding portion 18*b* into the movable body 6 can be easily performed.

An application container according to another example will be described with reference to FIGS. 16 to 18. The example application container includes a tubular member 20 formed of two components, instead of the tubular member 10 formed of one component. The tubular member 20 includes a first constituent member 21 and a second constituent member 22 joined to the first constituent member 21. Each of the first constituent member 21 and the second constituent member 22 includes the holding portions 11 described above. The first constituent member 21 includes the flange portion 14 and the connecting portion 12 described above.

Figure 16:
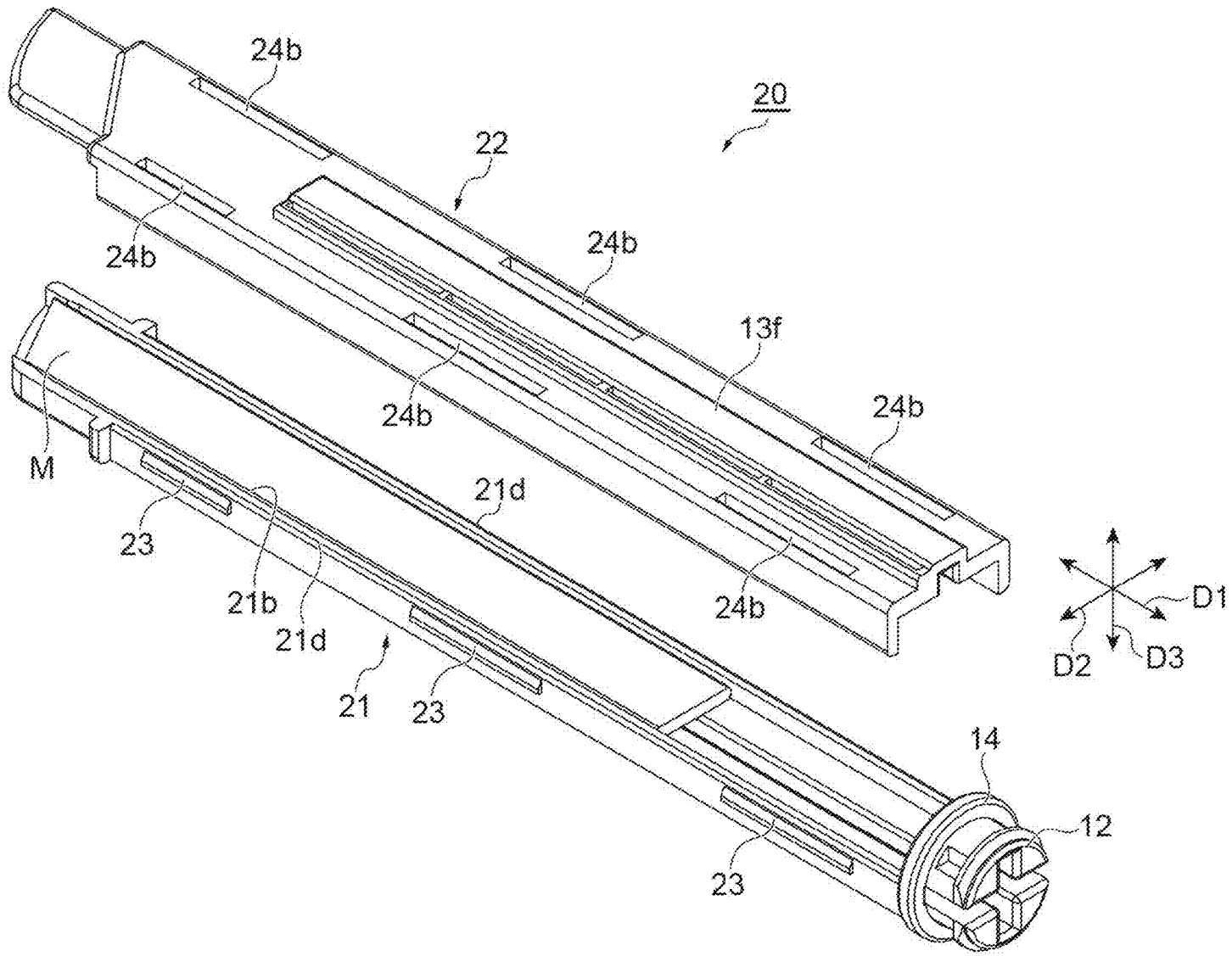
FIG. 16 is an exploded perspective view showing a first constituent member and a second constituent member of a tubular member according to another example.

FIG. 16 is a perspective view showing the first constituent member 21, the second constituent member 22, and the application material M. FIG. 17 is a perspective view showing the first constituent member 21. As shown in FIGS. 16 and 17, the first constituent member 21 includes a first recess 21*b* on which the application material M is placed. The first recess 21*b* has a recessed shape that the application material M enters.

The first recess 21*b* is defined by a bottom portion 21*c* extending in the axial direction D1 and the major axis direction D2, and a pair of side portions 21*d* extending upward from both ends of the bottom portion 21*c* in the major axis direction D2. The application material M placed on the first recess 21*b* is covered with the second constituent member 22, and the second constituent member 22 is joined to the first constituent member 21 in a state where the second constituent member 22 covers the application material M.

The first constituent member 21 and the second constituent member 22 are joined to each other along a direction orthogonal to the axial direction D1. In the example illustrated at FIGS. 16 to 18, the first constituent member 21 and the second constituent member 22 are joined to each other in a state where the first constituent member 21 and the second constituent member 22 are arranged along the minor axis direction D3. FIG. 18 shows a cross section of the tubular member 20 in which the second constituent member 22 is joined to the first constituent member 21, when taken along a plane orthogonal to the axial direction D1.

Figure 17:
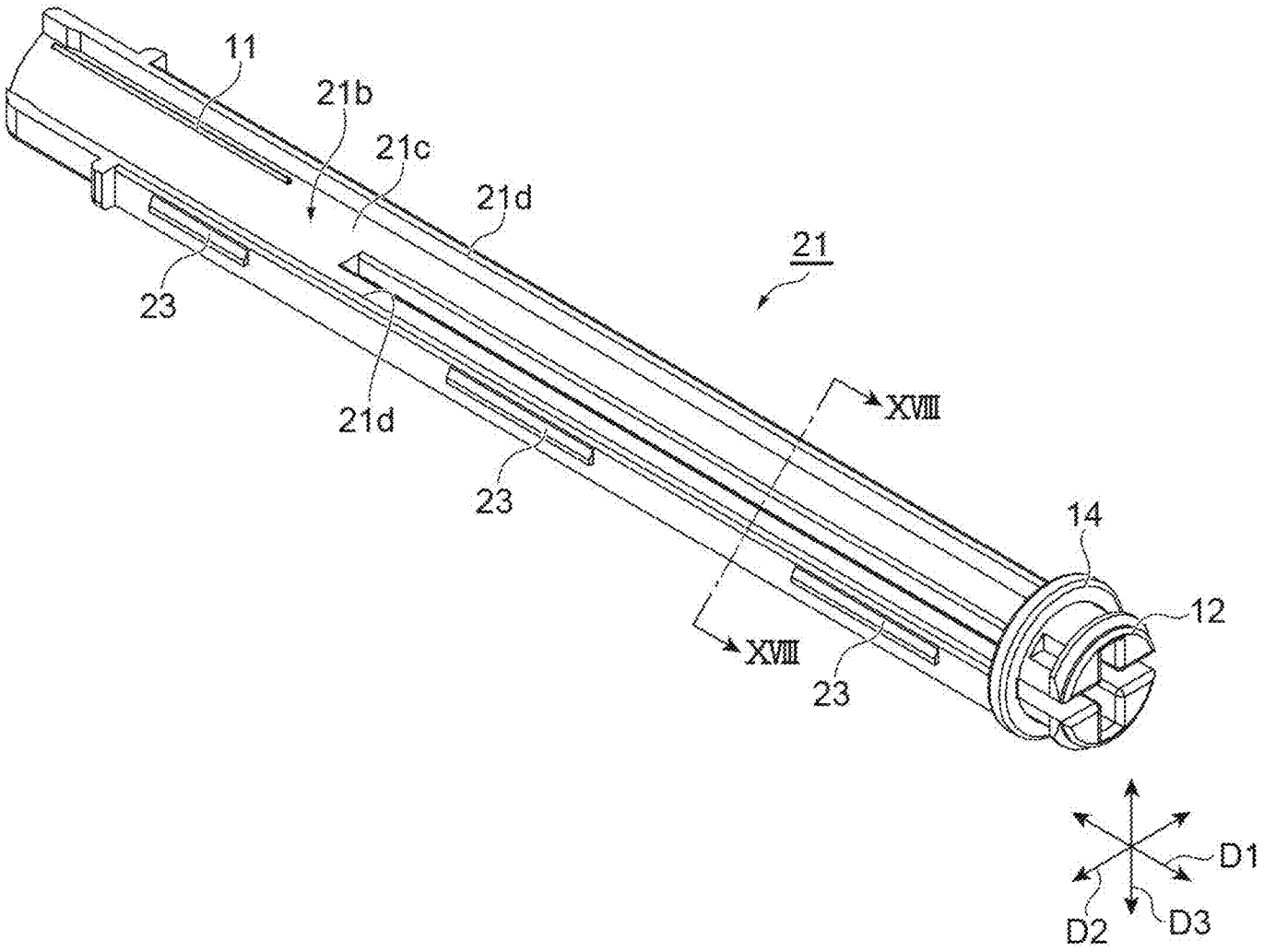
FIG. 17 is a perspective view showing the first constituent member of the tubular member illustrated at FIG. 16.
Figure 18:
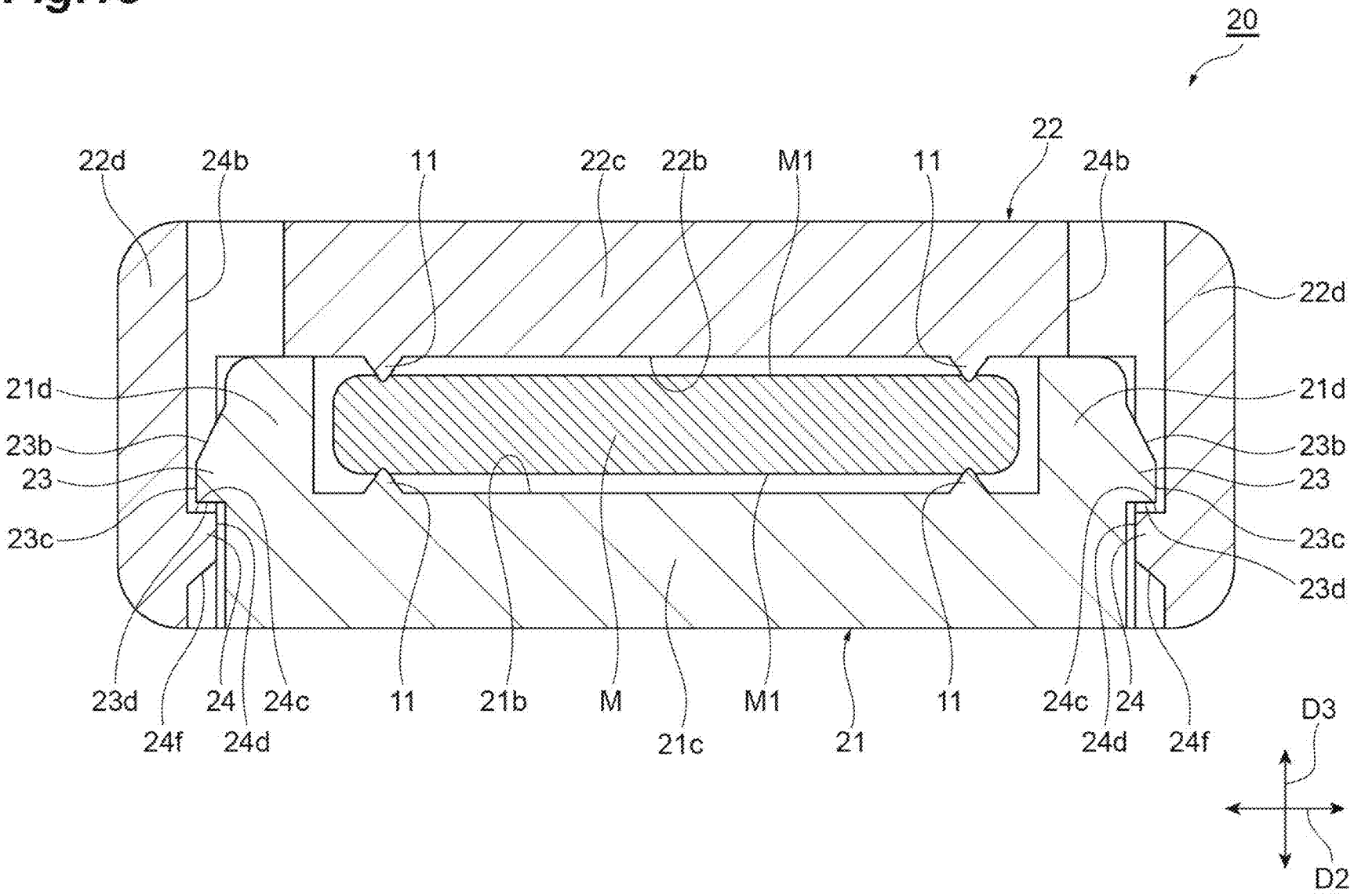
FIG. 18 is a cross-sectional view showing the first constituent member and the second constituent member illustrated in FIG. 17, taken in a plane orthogonal to the axial direction, along line XVIII-XVIII.

As shown in FIGS. 16 to 18, the first constituent member 21 includes first joining portions 23 joined to the second constituent member 22, and the second constituent member 22 includes second joining portions 24 joined to the first joining portions 23. The first joining portions 23 protrude to both end sides in the major axis direction D2 on each of the pair of side portions 21*d* of the first constituent member 21. The first joining portions 23 extend along the axial direction D1.

Each of the first joining portions 23 includes an inclined surface 23*b* extending obliquely downward from the side portion 21*d*; a top surface 23*c* extending downward from a lower end of the inclined surface 23*b*; and a lower surface 23*d* extending from a lower end of the top surface 23*c* to the side portion 21*d*. The first constituent member 21 includes a plurality of the first joining portions 23, and the plurality of first joining portions 23 are arranged along the axial direction D1. Further, the plurality of first joining portions 23 are arranged along the major axis direction D2.

A length (width) of the second constituent member 22 in the major axis direction D2 is longer than a length (width) of the first constituent member 21 in the major axis direction D2. The second constituent member 22 includes a second recess 22*b* that seals the first recess 21*b* of the first constituent member 21, and that accommodates the first constituent member 21. The second recess 22*b* is defined by a top portion 22*c* extending in the axial direction D1 and the major axis direction D2, and a pair of side portions 22*d* extending downward from both ends of the top portion 22*c* in the major axis direction D2.

The second joining portions 24 extend along the axial direction D1. The second joining portions 24 protrude to a center side in the major axis direction D2 on each of the pair of side portions 22*d* of the second constituent member 22. Each of the second joining portions 24 includes a bottom surface 24*c* of a hole 24*b* penetrating through the top portion 22*c* in the minor axis direction D3 and formed on a center side of the side portion 22*d* in the major axis direction D2; a top surface 24*d* extending downward from an end portion on a center side of the bottom surface 24*c* in the major axis direction D2; and an inclined surface 24*f* extending obliquely downward from a lower end of the top surface 24*d* toward the side portion 22*d*.

The second constituent member 22 includes a plurality of the second joining portions 24, and the second joining portions 24 is joined to the respective first joining portions 23. More specifically, when the first constituent member 21 enters the second recess 22*b* of the second constituent member 22, the inclined surfaces 23*b* of the first joining portions 23 come into contact with the inclined surfaces 24*f* of the second joining portions 24. Then, the second constituent member 22 is joined to the first constituent member 21 in a state where the first joining portions 23 move upward over the second joining portions 24 and the lower surfaces 23*d* face the bottom surfaces 24*c*.

As described above, the tubular member 20 according to the example illustrated at FIGS. 16 to 18, includes the first constituent member 21 and the second constituent member 22 joined to the first constituent member 21. In this case, the application material M can be held between the first constituent member 21 and the second constituent member 22. Therefore, by joining the second constituent member 22 to the first constituent member 21 in a state where the application material M is interposed between the first constituent member 21 and the second constituent member 22, the loading of application material M into the tubular member 20 can be easily performed.

The first constituent member 21 and the second constituent member 22 are joined to each other along the direction orthogonal to the axial direction D1. In this case, since the application material M can be held between the first constituent member 21 and the second constituent member 22 facing each other along the direction orthogonal to the axial direction D1, the loading and holding of the application material M can be easily performed.

The first constituent member 21 includes the first joining portions 23 joined to the second constituent member 22, the second constituent member 22 includes the second joining portions 24 joined to the first joining portions 23, and the first joining portions 23 and the second joining portions 24 extend along the axial direction D1. In this case, by extending both the first joining portions 23 and the second joining portions 24 along the axial direction D1, the joining of the second constituent member 22 to the first constituent member 21 can be easily performed.

The first constituent member 21 includes the first recess 21*b* that accommodates the application material M, and that extends along the axial direction D1, and the second constituent member 22 includes the second recess 22*b* that seals the first recess 21*b* which accommodates the application material M, and that accommodates the first constituent member 21. In this case, in a state where the application material M is accommodated in the first recess 21*b* of the first constituent member 21, the sealing of the first recess 21*b* and the accommodation of the first constituent member 21 in the second recess 22*b* can be performed. Therefore, the loading of the application material M and the joining of the second constituent member 22 to the first constituent member 21 can be easily performed.

With reference to FIGS. 16 to 18, the example in which the first constituent member 21 and the second constituent member 22 are joined to each other along the direction orthogonal to the axial direction D1 has been described. However, the first constituent member and the second constituent member may be joined to each other along a direction intersecting the axial direction D1 (for example, a direction extending obliquely with respect to the axial direction D1) rather than the direction orthogonal to the axial direction D1. In this manner, the direction in which the first constituent member and the second constituent member are joined is not particularly limited.

Figure 19:
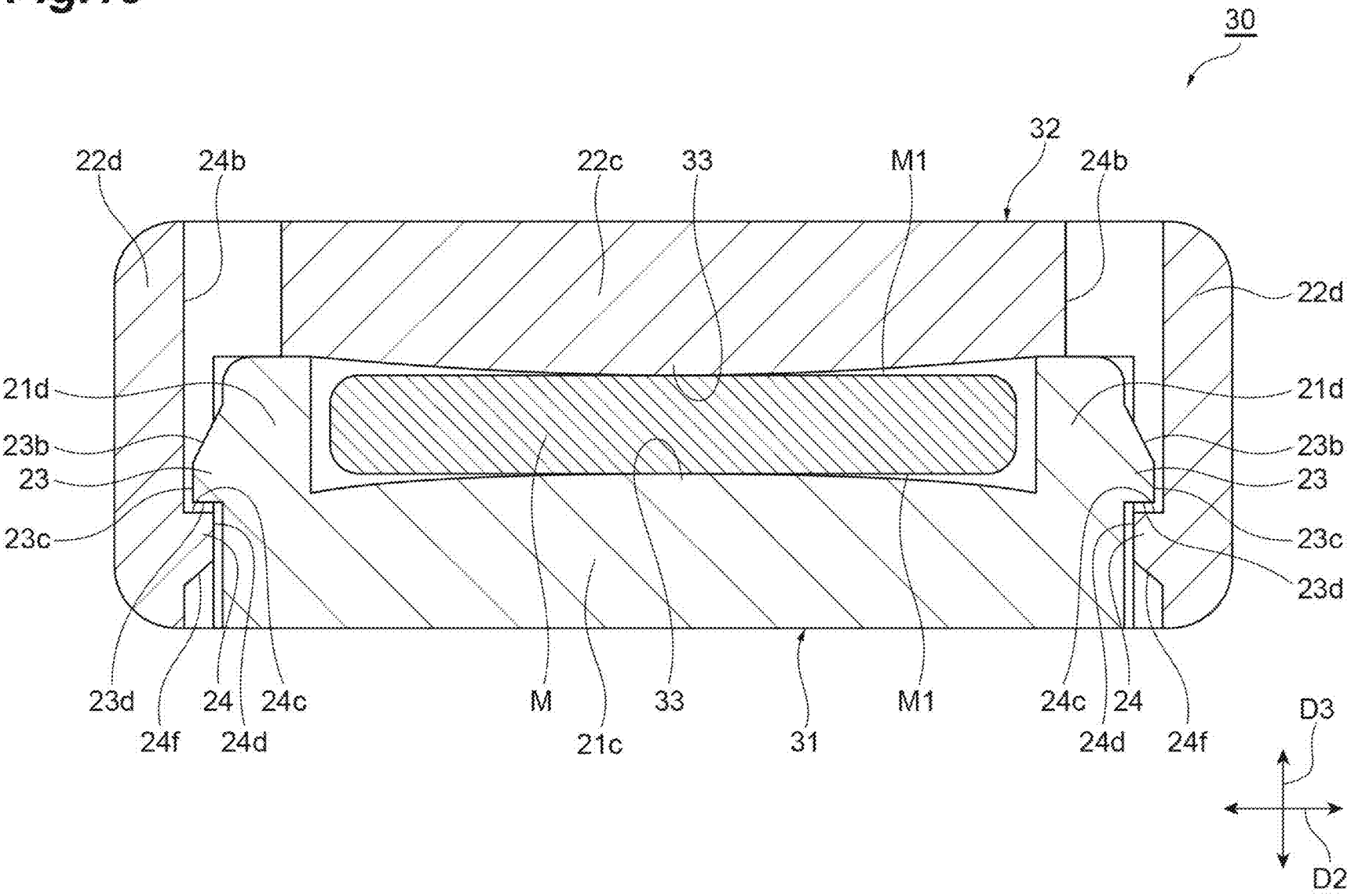
FIG. 19 is a cross-sectional view showing a first constituent member and a second constituent member according to another example.

FIG. 19 is a cross-sectional view showing a tubular member 30 including a first constituent member 31 and a second constituent member 32 according to another example. As shown in FIG. 19, the tubular member 30 is different from the tubular member 20 illustrated in FIG. 16, in that the tubular member 30 includes holding portions 33 having a shape different from that of the holding portions 11. Each of the first constituent member 31 and the second constituent member 32 includes the holding portion 33 that comes into contact with the flattened surface M1 of the application material M.

Each of the holding portions 33 is a protruding curved surface that comes into contact with the flattened surface M1. The holding portion 33 is formed on each of the bottom portion 21*c* and the top portion 22*c*. The holding portion 33 protrudes to a center side of the tubular member 30 in the minor axis direction D3 as the holding portion 33 extends toward the center of the tubular member 30 in the major axis direction D2.

Since the holding portions 33 hold the application material M in a state where the holding portions 33 are in contact with the flattened surfaces M1 of the application material M inside the tubular member 30, the application material M can be firmly held, and deformation and breakage of the application material M can be suppressed. Therefore, the same effects as those of the tubular member 10 and the tubular member 20 described above can be obtained from the tubular member 30.

Figure 20:
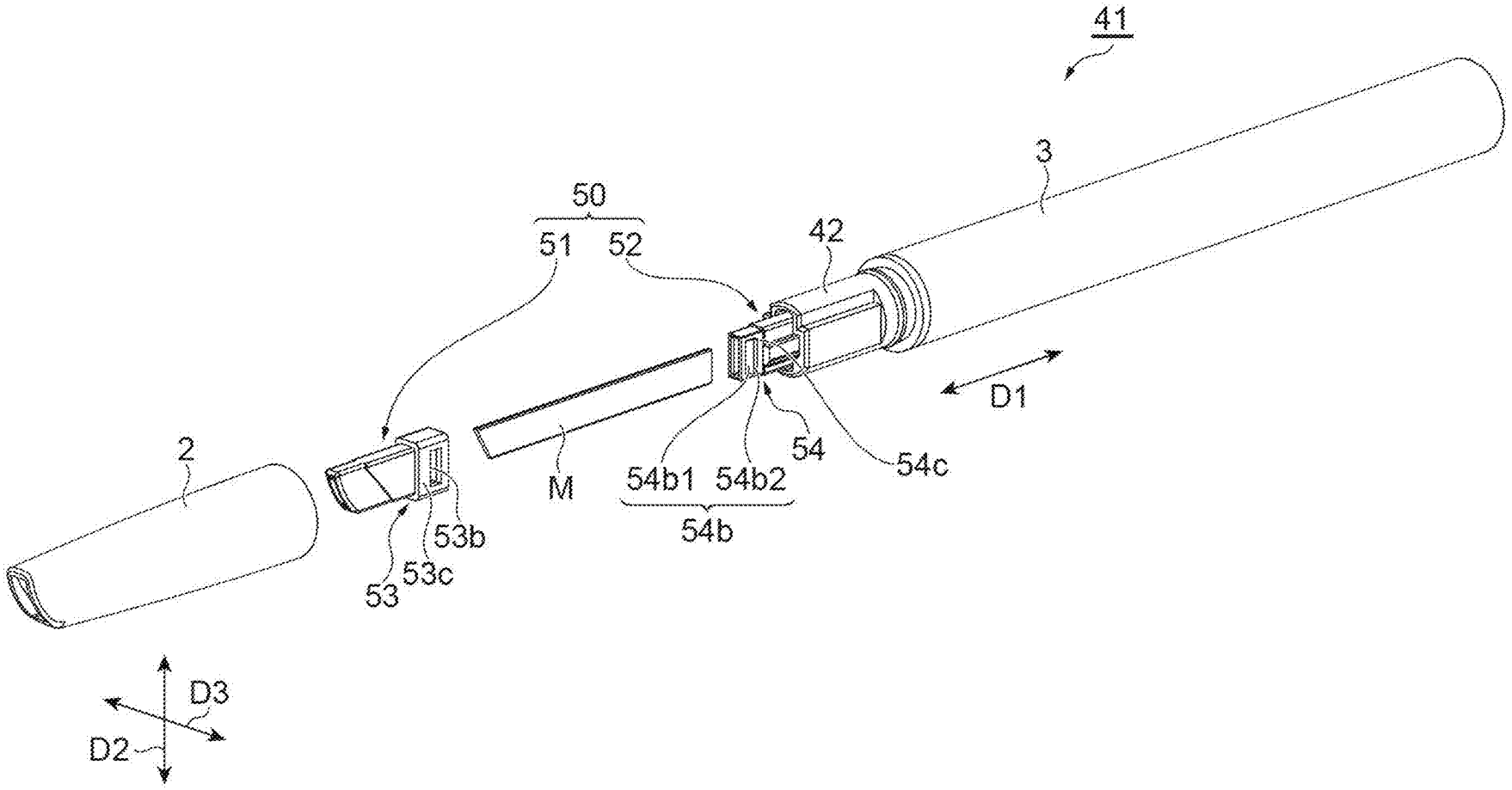
FIG. 20 is an exploded perspective view showing an application container according to another example.

FIG. 20 is an exploded perspective view showing an application container 41 according to another example. The application container 41 includes a tubular member 50 different from the tubular member 10 described above. The tubular member 50 includes a first constituent member 51 accommodated in the front tube 2, and a second constituent member 52 inserted into a middle tube 42 coupled to the rear tube 3.

The first constituent member 51 and the second constituent member 52 are joined to each other along the axial direction D1. The first constituent member 51 includes an accommodation portion 53 that the second constituent member 52 enters from the rear. The second constituent member 52 includes an insertion portion 54 that enters the accommodation portion 53. The accommodation portion 53 and the insertion portion 54 have, for example, a rectangular box shape.

The accommodation portion 53 has a through-hole 53*b* penetrating through the accommodation portion 53. The through-hole 53*b* penetrates through a side surface portion 53*c* of the accommodation portion 53 extending in the axial direction D1 and the major axis direction D2, in the minor axis direction D3. The through-hole 53*b* has a rectangular shape. The insertion portion 54 includes a protrusion 54*b* that enters the through-hole 53*b*.

The protrusion 54*b* protrudes outward in the minor axis direction D3 from a side surface portion 54*c* of the insertion portion 54 extending in the axial direction D1 and the major axis direction D2. The protrusion 54*b* includes an inclined surface 54*b*1 extending obliquely to the radial outside as the inclined surface 54*b*1 extends rearward with respect to the side surface portion 54*c*, and a top surface 54*b*2 extending in the axial direction D1 from an end portion of the inclined surface 54*b*1 opposite to the side surface portion 54*c*.

Figure 21A:
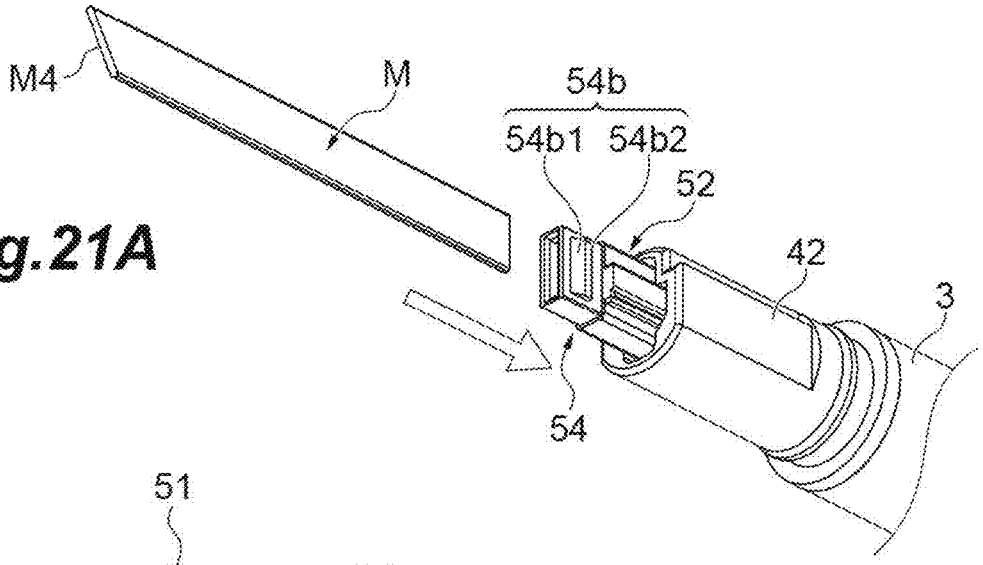
FIG. 21A is a perspective view showing a mode in which the application material is loaded into a second constituent member of the application container of FIG. 20.
Figure 21B:
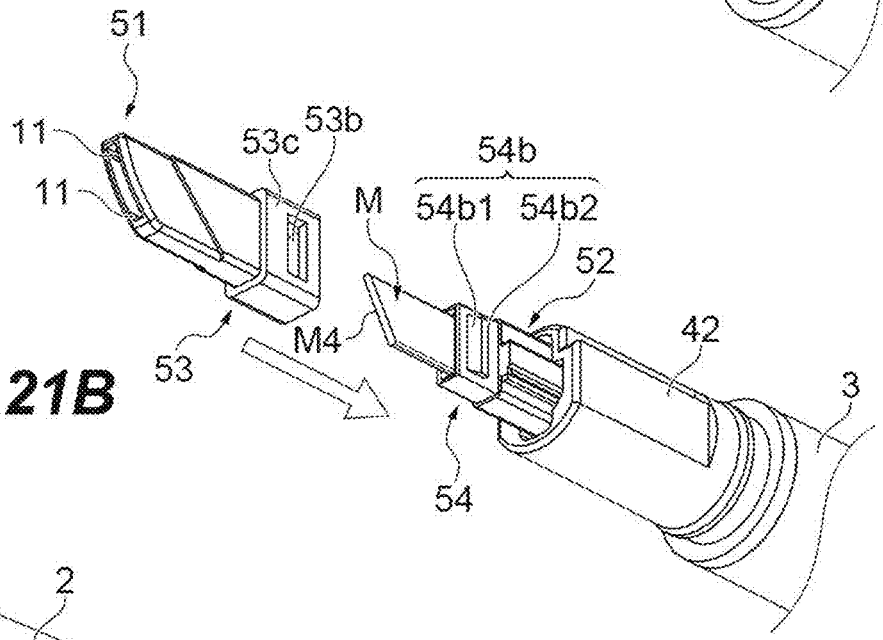
FIG. 21B is a perspective view showing a mode in which a first constituent member is joined to the second constituent member of FIG. 21A.
Figure 21C:
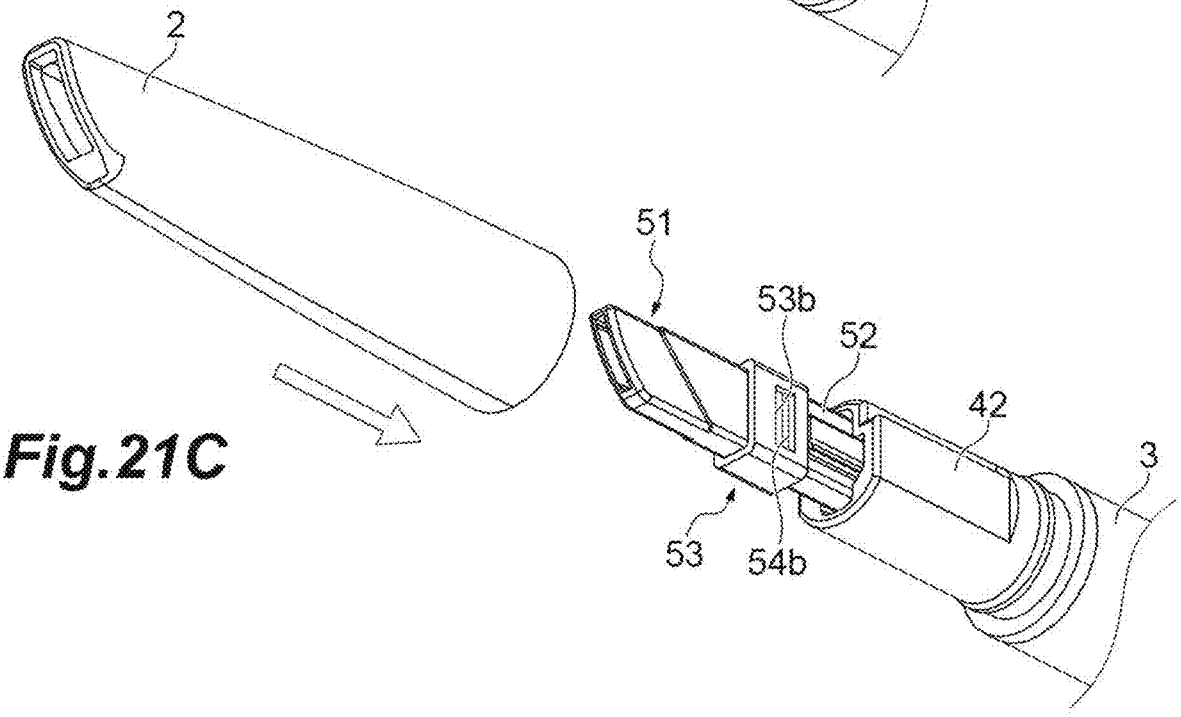
FIG. 21C is a perspective view showing a mode in which the front tube is mounted to the first constituent member and the second constituent member of FIG. 21B.

FIGS. 21A, 21B, and 21C are perspective views showing a procedure for loading the application material M into the tubular member 50 and assembling the application container 41. As shown in FIGS. 21A and 21B, the second constituent member 52 is inserted into the middle tube 42 from the front, and the application material M is inserted into the second constituent member 52 from the front.

At this time, the tip portion M4 of the application material M protrudes from the second constituent member 52. Then, as shown in FIGS. 21B and 21C, the first constituent member 51 provided with a plurality of the holding portions 11 that hold the application material M is joined to the second constituent member 52. At this time, the insertion portion 54 enters the accommodation portion 53, and the inclined surface 54*b*1 of the insertion portion 54 comes into contact with an inner surface of the accommodation portion 53. Then, the first constituent member 51 is joined to the second constituent member 52 in a state where the insertion portion 54 moves forward relative to the accommodation portion 53 and the protrusion 54*b* enters the through-hole 53*b*. Thereafter, the front tube 2 is mounted to the middle tube 42 to cover the second constituent member 52 and the first constituent member 51, and the assembly of the application container 41 is completed.

As described above, the first constituent member 51 and the second constituent member 52 are joined to each other along the axial direction D1. In this case, since the first constituent member 51 is joined to the second constituent member 52 along the axial direction D1, the joining of the first constituent member 51 to the second constituent member 52 can be easily performed.

Figure 22:
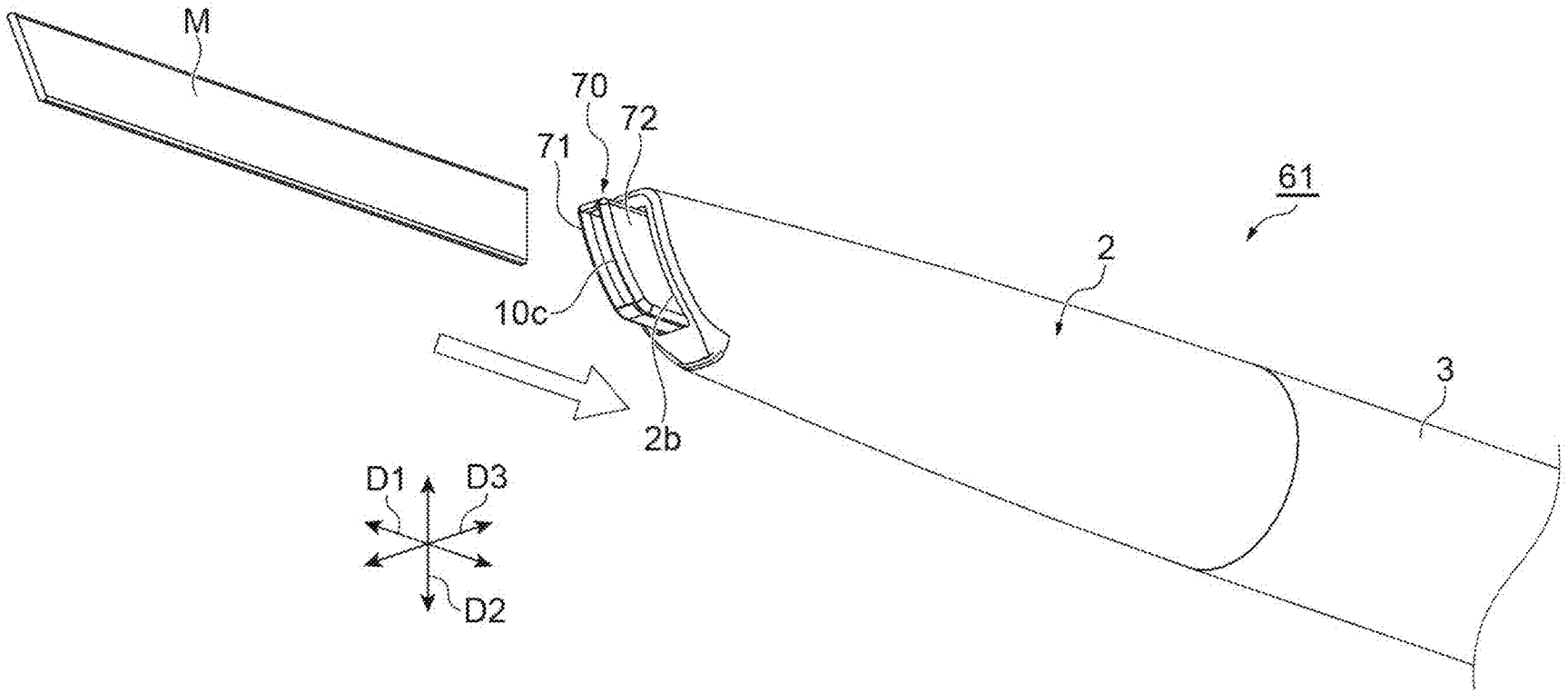
FIG. 22 is a perspective view showing a tubular member, the front tube, and the application material of an application container according to another example.
Figure 23A:
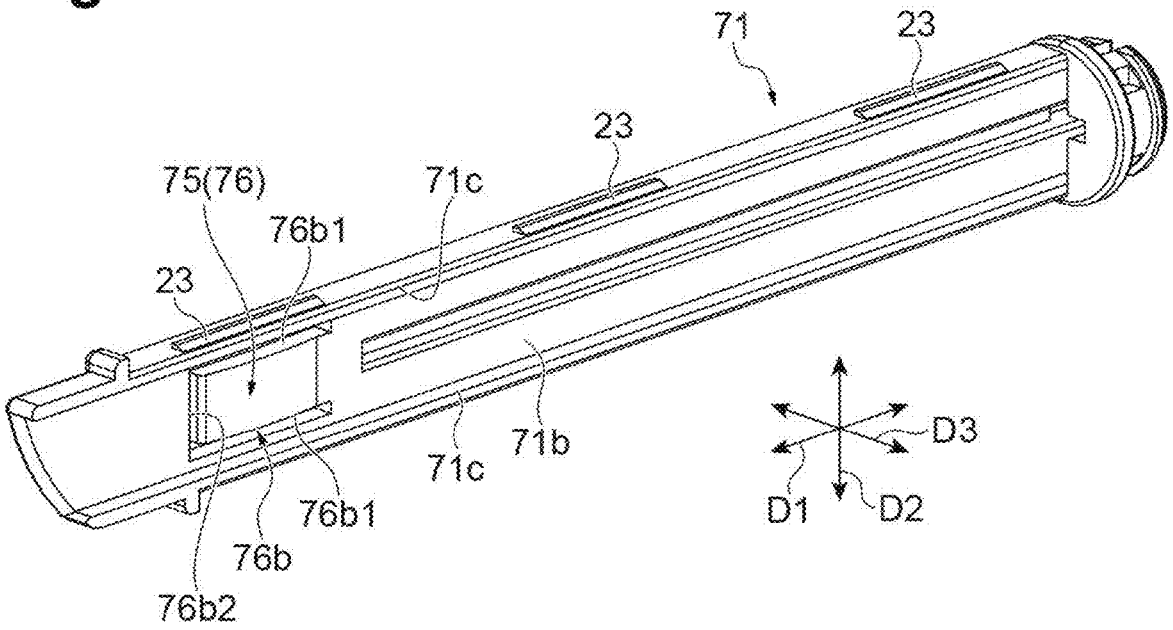
FIG. 23A is a perspective view showing a first constituent member of the tubular member of FIG. 22.
Figure 23B:
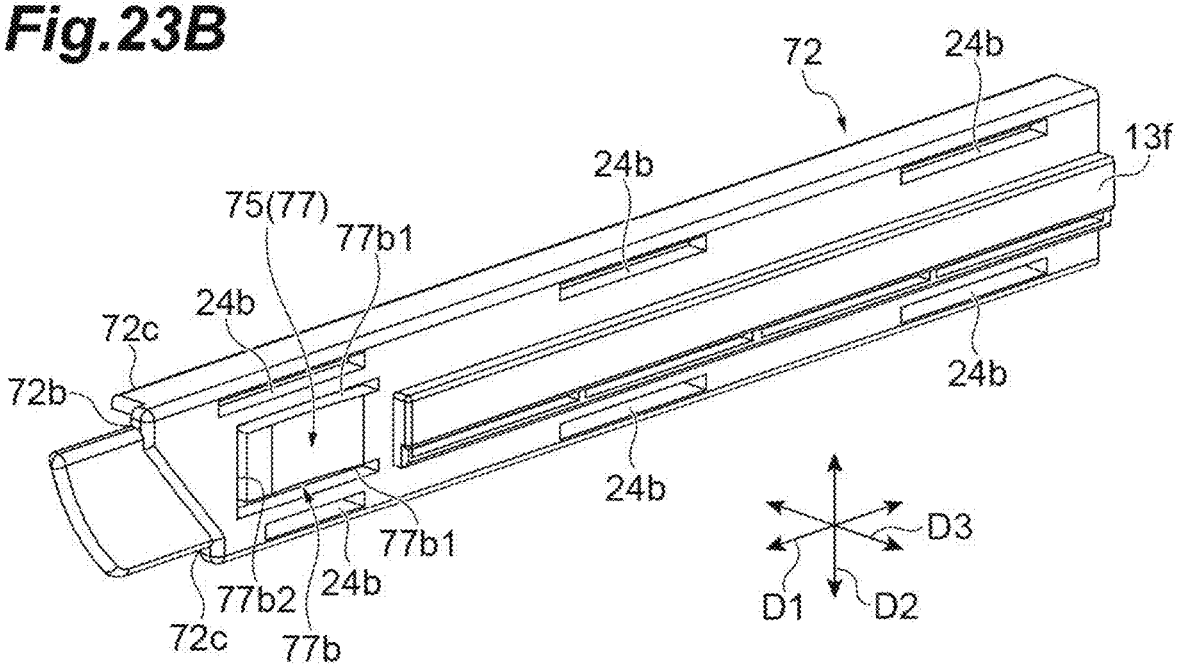
FIG. 23B is a perspective view showing a second constituent member of the tubular member of FIG. 22.

FIG. 22 is a perspective view showing the front tube 2, the rear tube 3, a tubular member 70, and the application material M of an application container 61 according to another example. FIG. 23A is a perspective view showing a first constituent member 71 constituting the tubular member 70. FIG. 23B is a perspective view showing a second constituent member 72 constituting the tubular member 70. As shown in FIGS. 22, 23A, and 23B, the tubular member 70 includes the first constituent member 71 and the second constituent member 72 joined to the first constituent member 71. The first constituent member 71 and the second constituent member 72 are joined to each other along the minor axis direction D3.

The tubular member 70 includes a leaf spring portion 75 that comes into contact with the application material M, instead of the holding portions 11 having a protruding shape described above. In the application container 61, the leaf spring portion 75 functions as a holding portion. The leaf spring portion 75 is elastically deformable along a thickness direction (minor axis direction D3) of the application material M. For example, the leaf spring portion 75 includes a first leaf spring portion 76 included in the first constituent member 71, and a second leaf spring portion 77 included in the second constituent member 72. The first leaf spring portion 76 is defined by a slit 76*b*. The slit 76*b* penetrates through the first constituent member 71 in the minor axis direction D3.

The slit 76*b* includes a pair of first slits 76*b*1 and a second slit 76*b*2 connecting the pair of first slits 76*b*1 to each other. The first slits 76*b*1 extend in the axial direction D1, and the pair of first slits 76*b*1 are arranged along the major axis direction D2. The second slit 76*b*2 extends in the major axis direction D2 to connect front ends of the pair of first slits 76*b*1 to each other. The slit 76*b* includes the pair of first slits 76*b*1 and the second slit 76*b*2, so that the slit 76*b* has a U shape.

Similarly to the first leaf spring portion 76, the second leaf spring portion 77 is defined by a slit 77*b* penetrating through the second constituent member 72 in the minor axis direction D3. The slit 77*b* includes a pair of first slits 77*b*1 and a second slit 77*b*2 connecting the pair of first slits 77*b*1 to each other. The configurations of the first slits 77*b*1 and the second slit 77*b*2 are the same as the configurations of the first slits 76*b*1 and the second slit 76*b*2 described above.

The first constituent member 71 includes a bottom portion 71*b* extending in the axial direction D1 and the major axis direction D2, and a pair of side portions 71*c* protruding in the same direction from both ends of the bottom portion 71*b* in the major axis direction D2. The first leaf spring portion 76 protrudes in a curved shape in the direction in which the side portions 71*c* protrude, as the first leaf spring portion 76 extends toward the center of the first leaf spring portion 76 in the axial direction D1. The second constituent member 72 also includes a bottom portion 72*b* and side portions 72*c* similarly to the first constituent member 71, and the second leaf spring portion 77 protrudes in a curved shape in the direction in which the side portions 72*c* protrude, as the second leaf spring portion 77 extends toward the center of the second leaf spring portion 77 in the axial direction D1.

The loading of the application material M into the tubular member 70 configured as described above is performed by inserting the application material M from the front. In a state where the first constituent member 71 is joined to the second constituent member 72, a central part of the leaf spring portion 75 in the axial direction D1 protrudes in a curved shape to a center side of the tubular member 70 in the minor axis direction D3.

Therefore, when the application material M is inserted into the tube hole 10*c* of the tubular member 70, the application material M comes into contact with the first leaf spring portion 76 and the second leaf spring portion 77, and the application material M is inserted while pushing out the first leaf spring portion 76 and the second leaf spring portion 77 to both end sides in the minor axis direction D3. Since the application material M is pressed from both sides in the minor axis direction D3 by the first leaf spring portion 76 and the second leaf spring portion 77 in a state where the application material M is inserted, the application material M can be firmly held in the tube hole 10*c*.

As described above, the shape of the tube hole 10*c* of the tubular member 70 when viewed along the axial direction D1 and the shape of the application material M when viewed along the axial direction D1 are a flattened shape having a major axis and a minor axis, and the application material M has flattened surfaces extending in the axial direction D1 and the major axis direction D2. The tubular member 70 includes a holding portion that holds the application material M by coming into contact with the flattened surface, and the holding portion is the leaf spring portion 75 defined by the slits 76*b* and 77*b* formed in the tubular member 70. The leaf spring portion 75 comes into contact with the application material M, and elastically deforms along the thickness direction of the tubular member 70. Therefore, the leaf spring portion 75 that elastically deforms can hold the application material M in a wide range by coming into contact with the flattened surface. Therefore, even when the leaf spring portion 75 holds the application material M having a flattened shape, since the leaf spring portion 75 comes into contact with the flattened surfaces to hold the application material M, the application material M can be held with an appropriate holding force, and deformation and breakage of the application material can be suppressed. Therefore, similar actions and effects as those of the application container 1 according to the above-described example and the like can be obtained from the application container 61 illustrated in FIG. 22.

With reference to FIG. 22, the example in which the leaf spring portion 75 is formed of the first leaf spring portion 76 included in the first constituent member 71 and the second leaf spring portion 77 included in the second constituent member 72 has been described. However, the leaf spring portion 75 may be formed of only one of the first constituent member 71 and the second constituent member 72. Further, the tubular member 10, the tubular member 20, the tubular member 30, or the tubular member 50 described above may include the leaf spring portion 75.

In the tubular member 70 according to the example illustrated at FIG. 22, the first constituent member 71 and the second constituent member 72 are joined to each other along the direction orthogonal to the axial direction D1 (minor axis direction D3). However, in the tubular member 70 including the leaf spring portion 75, the first constituent member and the second constituent member may be joined to each other along the axial direction D1, or may be joined to each other along a direction intersecting the axial direction D1 (for example, a direction extending obliquely with respect to the axial direction D1). Accordingly, the example illustrated at FIG. 22 may be modified for example, as to the direction in which the first constituent member and the second constituent member are joined.

It is to be understood that not all aspects, advantages and features described herein may necessarily be achieved by, or included in, any one particular example. Indeed, having described and illustrated various examples herein, it should be apparent that other examples may be modified in arrangement and detail is omitted. For example, the shape, size, material, number and disposition mode of each part of the application container according to the present disclosure can be changed as appropriate. In addition, various parts of the application containers from the examples described above can be combined as appropriate.

For example, the example application container 1 described above includes the front tube 2, the rear tube 3, the screw tube 5, and the movable body 6, in which the feed-out mechanism 15 includes the first screwing portion 16 that advances the screw tube 5 with respect to the front tube 2 and the second screwing portion 17 that advances the movable body 6 with respect to the screw tube 5. However, in other examples, the application container may be a container that does not include at least one of the front tube 2, the rear tube 3, the screw tube 5, and the movable body 6, and the feed-out mechanism may be a mechanism that does not include at least one of the first screwing portion 16 and the second screwing portion 17.

Additionally, the example application container 1 described above, includes the feed-out mechanism 15 that performs feeding-out of the application material M by the rotation of the rear tube 3 relative to the front tube 2 in the one direction. However, in other examples, the application container may be an application container including a feed-out mechanism that does not perform feeding-out by relative rotation. Namely, the application container may include a feed-out mechanism that is a mechanical push-out mechanism such as a knock type push-out mechanism, instead of relative rotation, and a drawing material may be pushed out by the feed-out mechanism, or the application container may include a squeeze type feed-out mechanism.

In addition, the example application container 1 described above includes the application material M that is a cosmetic. However, in other examples, the application material may be something other than a cosmetic. For example, the application material may be a core material used in a writing instrument such as crayons. In this manner, the application container according to the present disclosure is not limited to cosmetics, and can be applied to various application materials such as writing instruments and stationery.

What is claimed is:

1. An application container for an application material, the container comprising:

a tubular member including a tube hole configured to moveably accommodate the application material in an axial direction in which the tubular member extends, and an opening to expose the application material, wherein in a cross-section of the tubular member taken orthogonally to the axial direction, an inner peripheral surface of the tube hole forms a flattened shape that has a width in a major axis direction and a height in a minor axis direction, the width of the flattened shape being greater than the height, wherein the tubular member includes a holding portion configured to hold the application material by contacting the application material along at least a portion of a length of the application material in the axial direction, wherein the holding portion protrudes inwardly in the minor axis direction from the inner peripheral surface of the tube hole, and wherein the application container further comprises:

a front tube that accommodates the tubular member;

a first female screw formed inside the application container;

a rear tube coupled to the front tube to be rotatable relative to the front tube;

a screw tube provided inside the application container, and including a first male screw that is coupled with the first female screw and a second female screw formed on an inner surface of the screw tube;

a movable body that is configured to advance inside the screw tube in the axial direction, and that includes a second male screw that is coupled with the second female screw; and a feed-out mechanism configured to move the application material in the axial direction, wherein the feed-out mechanism includes a first screwing portion that is configured to advance the screw tube with respect to the front tube in the axial direction in response to a screwing action between the first female screw and the first male screw, and a second screwing portion that is configured to move the movable body with respect to the screw tube in the axial direction, in response to a screwing action between the second female screw and the second male screw, wherein, in response to a rotation of the rear tube relative to the front tube in one direction, the screw tube advances to an advance limit with respect to the rear tube, so that the tubular member and the application material protrude forward from the front tube, and wherein, in response to a rotation of the rear tube relative to the front tube in the one direction in a state where the screw tube reaches the advance limit, the movable body advances with respect to the screw tube, so that the application material is fed out of the tubular member.

2. The application container according to claim 1, wherein the tube hole has a first end forming the opening and a second end located opposite the first end in the axial direction, and wherein the holding portion is formed adjacent to the first end inside the tube hole and extends toward the second end.

3. The application container according to claim 1, wherein the holding portion has a protruding shape protruding in the minor axis direction, wherein the tubular member includes a plurality of the holding portions arranged along the major axis direction and arranged along the minor axis direction, and wherein the application material is interposed between the plurality of holding portions arranged along the minor axis direction.

4. The application container according to claim 1, wherein the tubular member includes a first constituent member and a second constituent member joined to the first constituent member, to encase the application material between the first constituent member and the second constituent member.

5. The application container according to claim 4, wherein the first constituent member and the second constituent member are joined to each other along a direction orthogonal to the axial direction.

6. The application container according to claim 4, wherein the first constituent member and the second constituent member are joined to each other along the axial direction.

7. The application container according to claim 1, wherein the first female screw is formed inside the front tube of the application container, and wherein the screw tube is provided inside the rear tube of the application container.

8. The application container according to claim 7, wherein in the feed-out mechanism, the screw tube is configured to rotate relative to the front tube to cause the screwing action between the first female screw and the first male screw, and the rear tube is configured to rotate relative to the screw tube to cause the screwing action between the second female screw and the second male screw.

9. The application container according to claim 8, wherein the screw tube is configured to rotate synchronously with the rear tube in response to the rotation of the rear tube relative to the front tube in the one direction while the screw tube advances toward the advance limit, and wherein the rear tube is configured to rotate relative to the screw tube in response to the rotation of the rear tube relative to the front tube in the one direction in a state where the screw tube reaches the advance limit.

10. An application container for feeding out an application material, the container comprising:

a tubular member including a tube hole configured to moveably accommodate the application material in an axial direction in which the tubular member extends, and an opening to expose the application material, wherein in a cross-section of the tubular member taken orthogonally to the axial direction, an inner peripheral surface of the tube hole forms a flattened shape that has a width in a major axis direction and a height in a minor axis direction, the width of the flattened shape being greater than the height, wherein the tubular member includes a holding portion configured to hold the application material by contacting the application material, wherein the holding portion is a leaf spring portion formed by a slit in the tubular member, wherein the leaf spring portion is configured to contact the application material, and is elastically deformable along the minor axis direction, and wherein the application container further comprises:

a front tube that accommodates the tubular member;

a first female screw formed inside the application container;

a rear tube coupled to the front tube to be rotatable relative to the front tube;

a screw tube provided inside the application container, and including a first male screw that is coupled with the first female screw and a second female screw formed on an inner surface of the screw tube;

a movable body that is configured to advance inside the screw tube in the axial direction, and that includes a second male screw that is coupled with the second female screw; and a feed-out mechanism configured to move the application material in the axial direction, wherein the feed-out mechanism includes a first screwing portion that is configured to advance the screw tube with respect to the front tube in the axial direction in response to a screwing action between the first female screw and the first male screw, and a second screwing portion that is configured to move the movable body with respect to the screw tube in the axial direction, in response to a screwing action between the second female screw and the second male screw, wherein, in response to a rotation of the rear tube relative to the front tube in one direction, the screw tube advances to an advance limit with respect to the rear tube, so that the tubular member and the application material protrude forward from the front tube, and wherein, in response to a rotation of the rear tube relative to the front tube in the one direction in a state where the screw tube reaches the advance limit, the movable body advances with respect to the screw tube, so that the application material is fed out of the tubular member.

11. The application container according to claim 10, wherein the tubular member includes a first constituent member and a second constituent member joined to the first constituent member, to encase the application material between the first constituent member and the second constituent member.

12. The application container according to claim 11, wherein the first constituent member and the second constituent member are joined to each other along a direction orthogonal to the axial direction.

13. The application container according to claim 11, wherein the first constituent member and the second constituent member are joined to each other along the axial direction.

14. The application container according to claim 10, wherein the first female screw is formed inside the front tube of the application container, and wherein the screw tube is provided inside the rear tube of the application container.

15. The application container according to claim 14, wherein in the feed-out mechanism, the screw tube is configured to rotate relative to the front tube to cause the screwing action between the first female screw and the first male screw, and the rear tube is configured to rotate relative to the screw tube to cause the screwing action between the second female screw and the second male screw.

16. The application container according to claim 15, wherein the screw tube is configured to rotate synchronously with the rear tube in response to the rotation of the rear tube relative to the front tube in the one direction, while the screw tube advances toward the advance limit, and wherein the rear tube is configured to rotate relative to the screw tube in response to the rotation of the rear tube relative to the front tube in the one direction in a state where the screw tube reaches the advance limit.

* * * * *